US009162738B1

(12) United States Patent
Faletra

(10) Patent No.: US 9,162,738 B1
(45) **Date of Patent: *Oct. 20, 2015**

(54) INFLATABLE LIFE RAFT WITH DETACHABLE ACCESSORY POUCH

(76) Inventor: Troy Faletra, Fort Lauderdale, FL (US)

( * ) Notice: Subject to any disclaimer, the term of this patent is extended or adjusted under 35 U.S.C. 154(b) by 385 days.

This patent is subject to a terminal disclaimer.

(21) Appl. No.: 13/312,657

(22) Filed: Dec. 6, 2011

Related U.S. Application Data

(63) Continuation-in-part of application No. 12/427,292, filed on Apr. 21, 2009, now Pat. No. 8,070,543.

(60) Provisional application No. 61/060,151, filed on Jun. 10, 2008.

(51) Int. Cl.
*B63B 35/58* (2006.01)
*B63C 9/04* (2006.01)

(52) U.S. Cl.
CPC ..... *B63C 9/04* (2013.01)

(58) Field of Classification Search
CPC ..... B63C 9/00; B63C 9/02; B63C 9/03; B63C 9/04; B63C 9/115; B63C 9/11; B63C 9/125; B63C 9/1255; B63C 9/13; B63C 9/15; B63C 9/155; B63C 9/18
USPC ..... 441/40–42, 88, 90–92, 96
See application file for complete search history.

(56) References Cited

U.S. PATENT DOCUMENTS

| | | | | |
|---|---|---|---|---|
| 2,114,301 | A * | 4/1938 | Harrigan | 244/148 |
| 2,467,037 | A * | 4/1949 | Kajdan | 244/148 |
| 6,394,867 | B1 | 5/2002 | Bianco | |
| 6,582,097 | B2 | 6/2003 | Chang | |
| 7,083,487 | B2 | 8/2006 | Weinel | |

* cited by examiner

*Primary Examiner* — Daniel V Venne
(74) *Attorney, Agent, or Firm* — H. John Rizvi; Gold & Rizvi P.A.

(57) ABSTRACT

An inflatable life raft having one or more air channels forming a generally rectangular shaped body when the raft is unfolded and inflated. Valves in fluid communication with the air channels for inflating and deflating the life raft. A storage carrier is integrally constructed with the life raft for storing the folded normally deflated life raft so that the raft can be easily carried, transported, and automatically deployed. The inflatable raft includes a waterproof pouch releasably attached to the raft for storing items such as a rope, flare launcher, strobe light, glow sticks, and whistle. A tether couples the life raft to a user, and a plurality of reflectors is attached to the surface of the inflatable life raft. A replaceable gas cylinder, and manual hand pump are operatively coupled to the valves for automatically or manually inflating the life raft.

15 Claims, 19 Drawing Sheets

INFLATABLE LIFE RAFT WITH DETACHABLE ACCESSORY POUCH

CROSS REFERENCE TO RELATED APPLICATION

This Continuation-In-Part Utility Patent Application claims the benefit of U.S. Non-Provisional patent application Ser. No. 12/427,292, filed on Apr. 21, 2009, now U.S. Pat. No. 8,070,543, issued on Dec. 6, 2011, which claims the benefit of U.S. Provisional Patent Application Ser. No. 61/060,151, filed on Jun. 10, 2008, which is incorporated herein in its entirety.

FIELD OF INVENTION

The present invention relates to a floatation device, and more particularly, to an inflatable life raft adaptable for recreational use or personal safety. The inflatable life raft includes a detachable waterproof pouch for container basic essentials, a tether, reflectors, and a storage carrier for storing the raft in a deflated, folded configuration for easily carrying, transportation, and unencumbered deployment the life raft.

BACKGROUND OF THE INVENTION

There are a variety of floatation devices available on the market today. Some examples of floatation devices include boats, rafts, mattresses, tubes, watercrafts and floats. Some of the floatation devices are formed from pressurized pontoons, shaped fiberglass, or a dense foam material designed to provide the requisite bouncy needed for the floatation device to remain afloat. Popular floatation devices known in the art include inflatable life rafts. Inflatable life rafts provide the advantages of being compact, inexpensive to purchase, lightweight, and easy to store and transport when deflated.

Generally, inflatable life rafts are designed for either recreational use or are adapted for emergency or rescue operations. Most inflatable life rafts used for recreational activities typically include inflatable rafts or mattresses that are fabricated from a plastic or other gas impervious material forming one or more inflatable chambers for receiving air therein through an inflation valve. Most inflatable rafts do not provide an integrally formed storage carrier for storing the raft when in a deflated configuration. It is common that on many occasions, a user does not take the requisite time needed to adequately deflate the inflatable raft after use, resulting in the raft material rotting over time. In those occasions when a user does deflate the inflatable life raft, the user generally gathers the deflated raft together in a bundle making it difficult for storing, carrying and transporting the bulky raft. Most prior art inflatable rafts cannot be easily stored in a backpack, in luggage, hung in the closet, or conveniently transported effectively. In an emergency, the raft is not configured for a rapid and unencumbered deployment.

On occasion, a user may wish to bring along accessories when using an inflatable raft. Some examples of accessories may include beverages, food, rope, or safety equipment in general. These items could become essential in an emergency situation. Prior art inflatable rafts do not provide a container for storing accessories on the raft itself. In most situations, the user must store accessories in a separate container typically worn on the person or left in a nearby location away from the raft. Carrying and transporting a separate container on the person or leaving the container nearby for use is cumbersome, and often times impractical. In addition, most prior art inflatable rafts typically include a cord or rope attached to the raft for allowing a user to grasp the rope with one hand to hold onto the raft. However, the user is forced to actively hold onto the rope with the one hand making it difficult for the user to make use of both hands that may be freely used for swimming or signaling.

Often times when boating, some individuals feel nervous in relying only on a lift jacket. For some people a life jacket is just not enough. In the event of an emergency on the water, the life jacket does not offer the luxury of having life saving accessories available to the wearer. Further, in situations where only one floatation device is available to a plurality of people, such as a lifeboat, many individuals have difficulty swimming or simply cannot swim to a deployed lifeboat. Lifeboats tend to be bulky, expensive and permanently stored on a vessel.

Accordingly, there remains in the art a need for an inflatable life raft designed for recreational use, emergency use, or rescue operations where the inflatable life raft is inexpensive, easy to inflate, and includes a detachable accessory pouch for storing a variety of accessories available to a user. There is also a need for an inflatable life raft that is stored in a compact carrying case in folded form for easy transport, is readily accessible to anyone in time of need, and can be easily stored in a variety of places.

SUMMARY OF THE INVENTION

The present invention overcomes the deficiencies of the known art and the problems that remain unsolved by providing an inflatable recreational or personal safety life raft. A deployable inflatable lift raft carrier assembly is configured to store, retain, and when needed, deploy an inflatable life raft from within the carrier by simply pulling upon a cylinder actuating grip. The inflatable life raft can include a removable waterproof pouch for storing essential safety contents therein. The inflatable life raft includes a body tether for coupling the life raft to a user in any desired body part, including an ankle, a wrist, and the like, and a plurality of reflectors for signaling the location and position of the inflatable life raft.

In accordance with one embodiment of the present invention, there is provided a folded normally deflated life raft comprising a plurality of longitudinal extending air channels parallel to each other forming a generally rectangular shaped body when the life raft is in an unfolded and inflated configuration. Valves are in fluid communication with the air channels for inflating and deflating the air channels. An accessory pouch is releasably attached to one surface of the body, wherein the accessory pouch is shaped and sized to store a plurality of accessories therein. A tether is connected to the body and is adapted for being removeably connected to a user's waist, ankle or wrist. For added convenience, a storage container or carrier is integrally constructed with the body, where the storage container or carrier includes a fastener for securely storing the life raft therein. The body is deflatable and foldable from the unfolded and inflated configuration to a folded and deflated configuration in which the body is stored within the storage container and secured within the storage container. The storage carrier also includes a clip for securing the folded life raft to a person, object or for hanging.

Preferably, the folded normally deflated life raft is fabricated from a resilient material comprising any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvas, vinyl/canvass, or any combination thereof.

Advantageously, the valves comprise a one-way inflation valve for inflating the life raft, the one-way inflation valve including a pivoting stem and mouth piece, and a deflator valve for releasing air from the air channels. The tether includes a tether strap having one end attached to the body, and a second end attached to an ankle attachment for removeably coupling the life raft on a user's ankle, wrist, belt or waist.

Preferably, the accessory pouch includes a fastener for securely storing a variety of accessories. The variety of accessories can include rope, a flare launching system, a strobe light, glow sticks, matches, a reflective material, a whistle, food rations, an emergency position-indicating radio beacons (commonly referred to as an EPIRB), and the like. The whistle can include a receptacle for receiving items and keeping said items dry, and a closure having a reflecting mirror and a compass.

Advantageously, the normally folded deflated raft includes a plurality of reflectors disposed on the top surface of the body. The normally folded deflated life raft also includes a plurality of grommets disposed along an outside perimeter flap of the raft. One or more surfaces of the raft include any one of a plurality of different colors, a plurality of florescent colors, or any combination thereof.

In yet another embodiment, there is provided an inflatable life raft comprising a first resilient sheet joined and sealed to a second resilient sheet to form a generally, rectangular shaped body having an inflatable air chamber, and an outside perimeter flap. An envelope is integrally formed to the second resilient sheet where the envelope defines an opening for receiving the inflatable life raft in folded form. The envelope includes a fastener for securely storing the inflatable life raft therein, and a clip for attaching the inflatable life raft to a person, object or for hanging the device in a closet. Valves are in fluid communication with the air chamber for inflating and deflating the air chamber. A storage bag sized and shaped to store items therein is removeably attached to the first resilient sheet with a fastener, and a holding strap is attached to the inflatable life raft for coupling the inflatable life raft to a user's ankle, waste or wrist.

Preferably, the fastener includes any one of a spring clip, zipper, hook and loop, buckle, snaps, strap, cord, quick release, magnets, hooks, clasps, carabiner, or any combination thereof.

In an alternative embodiment there is provided an inflatable recreational or personal safety raft comprising a first resilient sheet joined and sealed to a second resilient sheet to form a rectangular shaped body having a plurality of longitudinally extending inflatable air tubes parallel to each other, and an outer perimeter flap. A storage carrier is integrally formed to the second resilient sheet. The storage carrier defines an opening for receiving the inflatable raft in folded deflated form. A valve assembly is in fluid communication with the inflatable air tubes. Included is a waterproof pouch adapted to store contents therein where the waterproof pouch is removeably attached to the first resilient sheet with a fastener. A tether is attached to the inflatable raft. The tether includes a fastener for coupling the inflatable raft to a user's ankle, waste or wrist.

Advantageously, the resilient sheets may comprise a single ply or multiple ply of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

Advantageously, the inflatable life raft further includes a replaceable air cylinder, and a manual air pump. The replaceable air cylinder is stored within a cylinder loader and coupled to a one valve for inflating the life raft. A manual air pump is releasably coupled to another valve for manually inflating the life raft.

Regarding the embodiments described herein, as well as those covered by the claims, the inflatable life raft or life raft may be constructed in different sizes and dimensions, and include one or more fluorescent colors. The storage carrier or envelope may include markings, letters, indicia, figures, characters, numbers, or the like disposed on the outer surface for identification. The waterproof pouch, accessory pouch or storage bag is shaped and sized to hold a variety of different small items or products, and may include a transparent or opaque covering.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In addition, the terms "accessories" or "items" as used herein includes all manner of small and portable items, products or articles, that a user may wish to keep secure and readily available, and the term "pouch" as used herein includes any container, receptacle, storage, bag, or any other device or method of storing items, articles or products.

Figure 1:
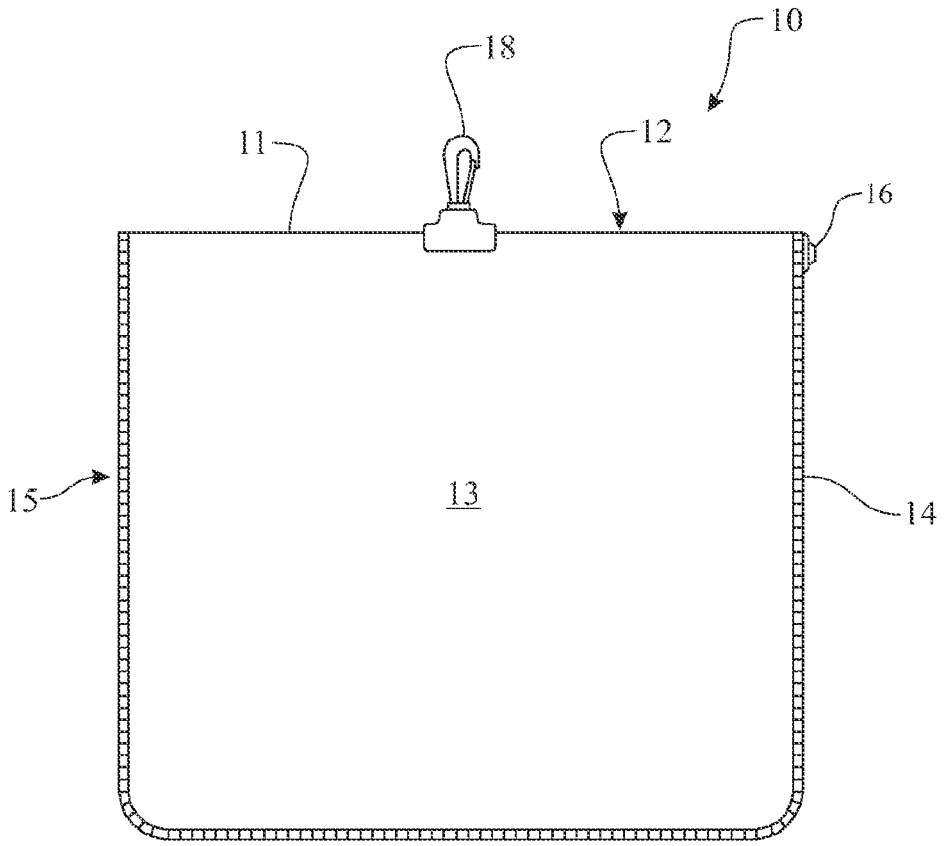
FIG. 1 presents a top view of an exemplary inflatable life raft illustrated in a deflated and folded configuration and stowed in a storage carrier.
Figure 8:
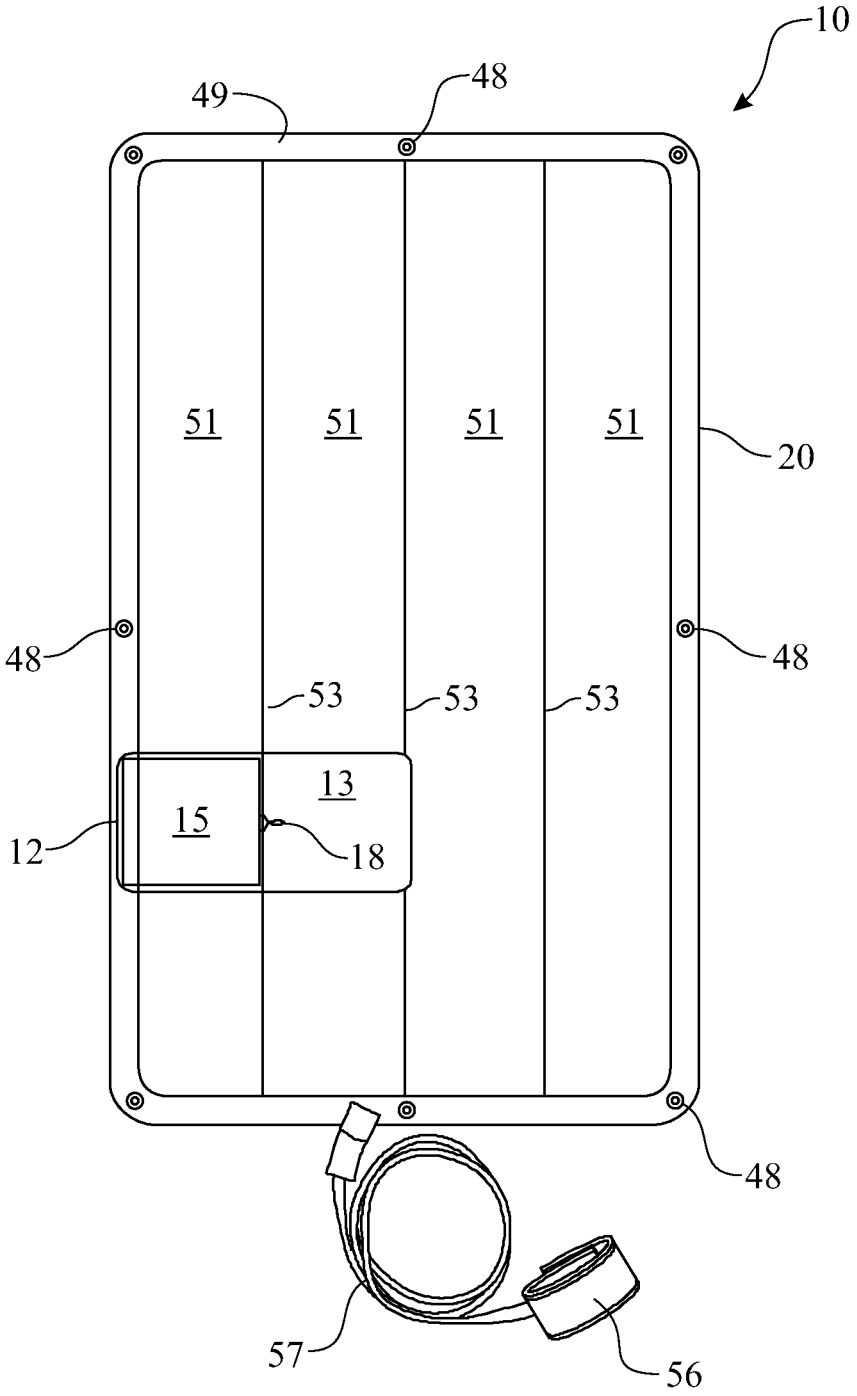
FIG. 8 presents a bottom view of the unfolded, deflated, inflatable life raft fabricated including a series of parallel arranged air chambers, air channels, or air tubes and having a storage carrier integrally constructed with the raft body and a tether.

A plan view of an inflatable life raft 10 is shown in a normally deflated and folded configuration in an illustration presented in FIG. 1. The inflatable life raft 10 is folded in both the longitudinal and transverse directions and conveniently stored in a storage carrier 12. The storage carrier 12 is integrally formed with or integrally attached to a bottom surface of the inflatable life raft 10, as best illustrated in FIG. 8. The storage carrier 12 includes a first storage panel 13 and a second storage panel 15, and is generally shaped and dimensioned to form a square or rectangular opening for receiving the inflatable lift raft 10 in a folded form. A fastener 14, 16, such as a zipper, is disposed partially along the outer perimeter of each storage panel 13, 15 to releasably join each panel 13, 15 together about a peripheral edge. The storage carrier 12 can also include a flexible, material hinge 11. Upon disengaging fastener 14, 16, storage panels 13, are unfolded open along hinge 11 like a book to expose the contents stored within the storage carrier 12. Examples of suitable fasteners 14, 16 may also include snaps, a dense hook and loop interface, magnets and the like. The storage carrier 12 enables the inflatable life raft 10 to be folded-up and arranged into a form factor of a handbag or carrying bag.

A attachment clip 18 is attached to the outer surface of the storage carrier 12 for releasable attaching the portable, inflatable life raft 10 to a person, life vest, belt, or for simply hanging the inflatable life raft 10, if desired. The attachment clip 18 may include any one of a clamps, buckles, spring clips, clips, quick release buckles, snaps, rings, snap rings, eyehooks, carabiners, hook and loop fasteners, displaced eyelets and lace, web slides, couplings, clasps, S-hooks, spring detents, fasteners, suction-cups, links, clasps, straps, any combination thereof, or any other suitable fastener known in the art.

The outer surface of either or both panels 13, 15, of inflatable life raft 10, may include any one of a variety of different colors, letters, characters, figures, symbols, markings, indicia, or the like. In one exemplary embodiment, the words, "Personal Safety Life Raft', may be printed on the outer surface of panel 13 to identify the device to a user. In another embodiment, the name of the owner or associated vessel may be printed on the outer surface of panel 13 to identify the owner or respective vessel associated with the inflatable life raft 10. Further, storage carrier 12 may include one or more handles for easily carrying and transporting the lift raft 10.

Inflatable life raft 10 is constructed of a resilient, gas impervious, flexible material, and preferably shaped into a generally rectangular or square shape. The resilient material is composed of any gas impervious material, and can be selected from a group consisting of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, any combination thereof, and the like. The material selected should be flexible or elastic enough to permit inflation of the inflatable life raft 10, yet, strong and durable enough to resist puncturing. It is also desirous that the material is not susceptible to dry rot or any other degrading process during storage.

Preferably, single ply or multiply sheets, of the resilient, flexible material, are joined and sealed together along the outer edge or perimeter. In addition, the plural sheets of flexible material are sealed together along a plurality of longitudinal seams 53 to form a series of inflatable air tubes, or channels. The inflatable tubes can be arranged having a parallel relationship with one another and are also in fluid communication with each other. It will be understood that single ply or multiply sheets may be sealed together using simple heat sealing methods, such as dielectric heating, sonic welding, ultrasonic welding, gluing, adhesively bonding, using vulcanization techniques or any other well know methods of joining and sealing rubberized or thermoplastic materials together.

The inflatable life raft 10 may be provided in any of a variety sizes. In some non-limiting examples, inflatable life raft 10 may be 49 inches in length and 29 inches in width, 60 inches in length and 29 inches in width, 72 inches in length and 29 inches in width, or 60 inches length and 36 inches in width. These are but a few dimensional examples, and it will be understood that the inflatable life raft 10 of the present invention may be fabricated to provide a large variety of sizes to accommodate children and adults alike.

Figure 2:
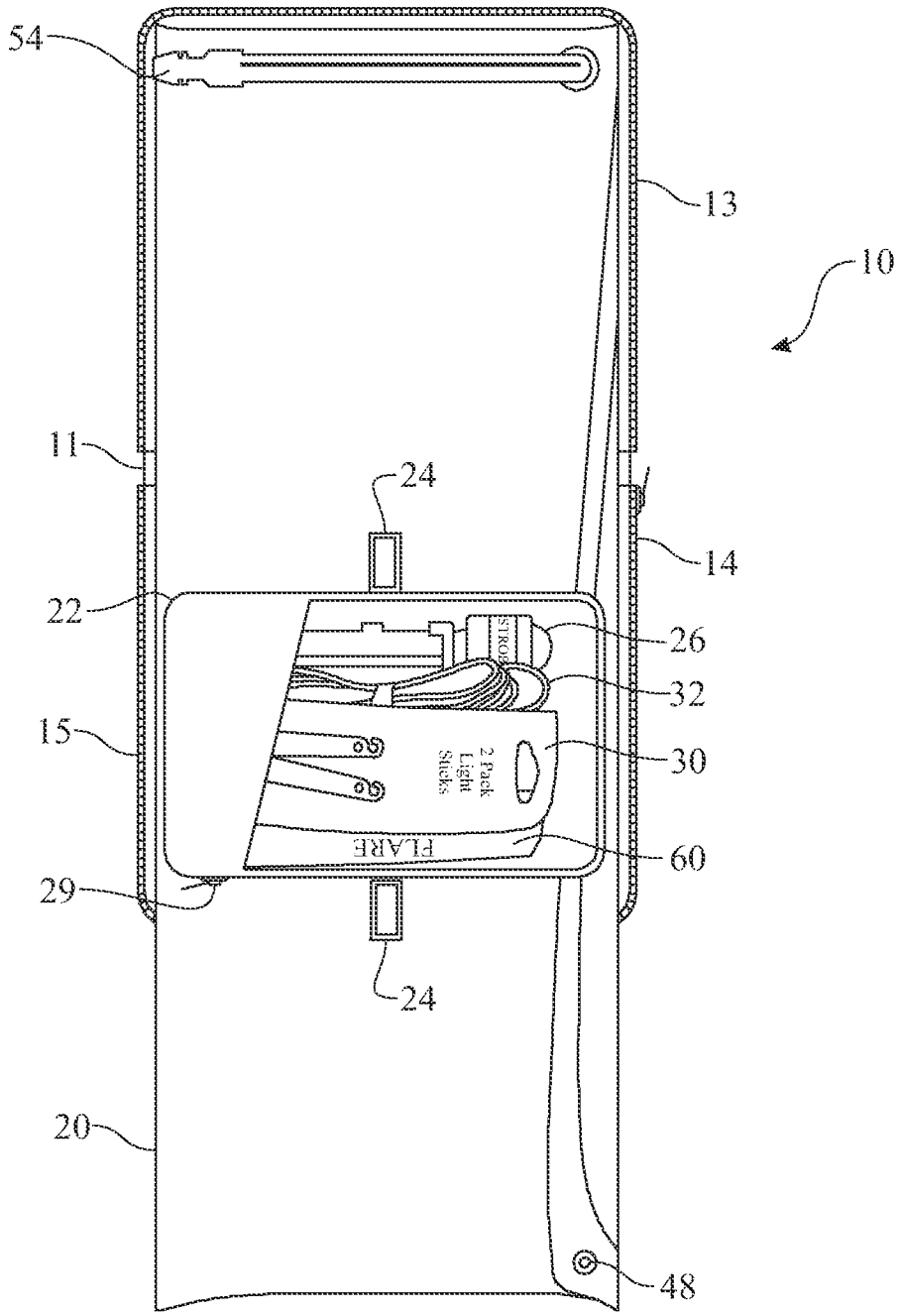
FIG. 2 presents a top view of the exemplary inflatable life raft originally introduced in FIG. 1, wherein the inflatable life raft is shown in a deflated and partially unfolded configuration, wherein the illustration introduces a detachable accessory pouch and an inflating valve.

A top view of the inflatable life raft 10 introduced in FIG. 1, is shown partially unfolded and in a deflated state in FIG. 2. The fastener 14, 16, of storage carrier 12 is unzipped and the panels 13, are unfolded along hinge 11 to expose the inflatable life raft 10. As shown, inflatable life raft 10 includes an accessory pouch 22. The accessory pouch 22 is detachably connected to one side of the raft 10 by pouch fasteners 24 such as a dense hook and loop interface. The pouch fasteners 24 are affixed to a top surface of the inflatable life raft 10 and to the mating surface of the accessory pouch 22, such as a bottom surface thereof. The accessory pouch 22 is detachably secured to the inflatable life raft 10 by correspondingly attaching the sections of the dense hook and loop interface together. Thus, accessory pouch 22 is releasably attached to the inflatable life raft 10 and is readily accessible to a user at all times.

The inflatable life raft 10 further includes a one-way inflator valve 54. The exemplary one-way inflator valve 54 includes a mouth piece and a pivoting stem. The inflator valve 54 is provided in fluid communication with an inflatable chamber or air tubes of the inflatable life raft 10 for quick and easy inflation of the inflatable life raft 10. The inflator valve 54, also illustrated in FIGS. 7 and 9, enables a user to pivotally align a stem of the valve towards the user's mouth, thus easily allowing insertion of the valve mouth piece between the lips of a user so as to quickly inflate the inflatable life raft 10 within minutes. Inflator valve 54 is a one-way valve permitting air to flow in one direction thus preventing air from escaping out from valve 54.

Figure 3:
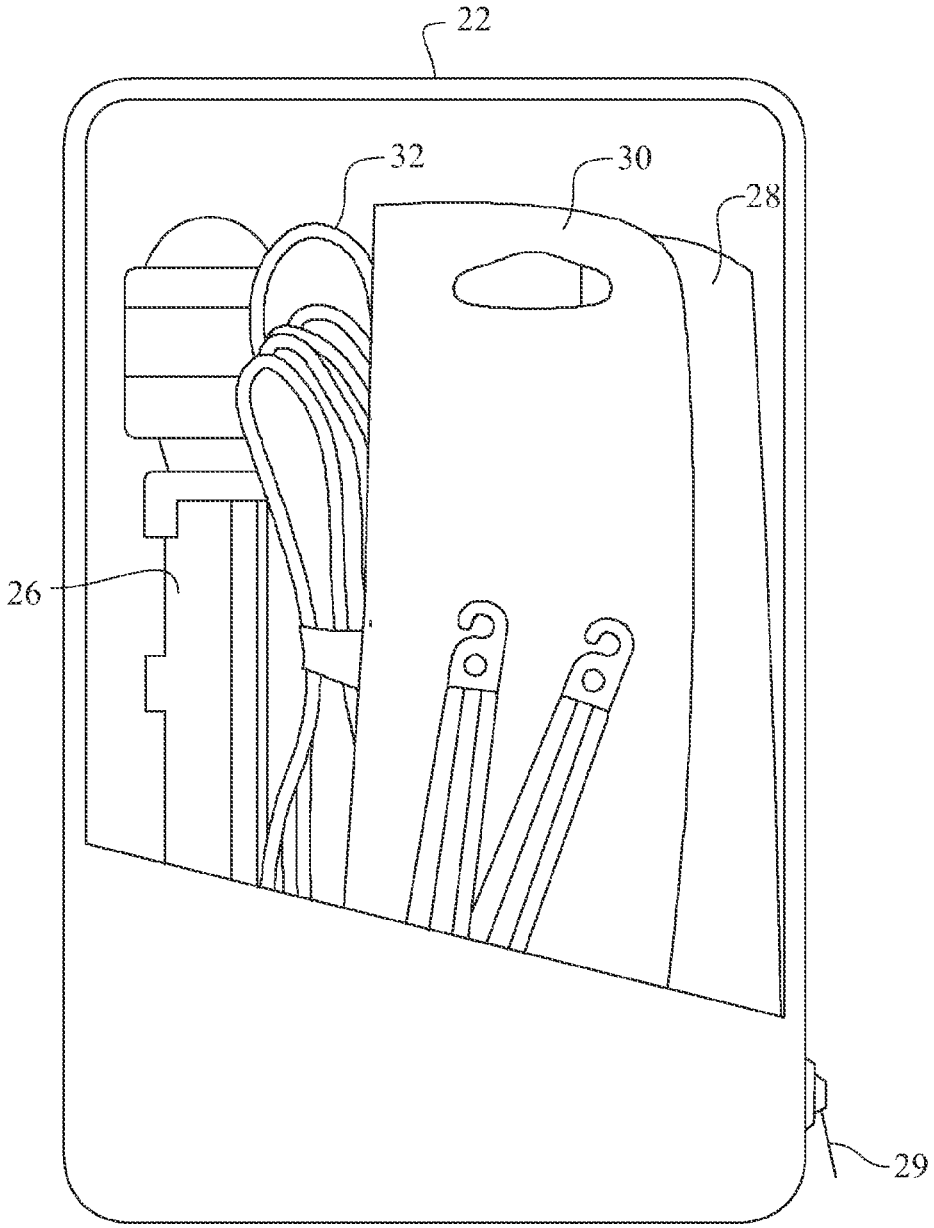
FIG. 3 presents a front view of the detachable accessory pouch including a variety of different accessories stored therein.

A front view of the detachable accessory pouch 22, including a variety of different accessories stored therein, is presented in FIG. 3. The accessory pouch 22 may include an opaque or transparent window enabling a user to visually inspect the contents of the pouch 22. The accessory pouch 22 includes a fastener, preferably a zipper 29, for securely storing the accessories therein. The accessory pouch 22 is fabricated of a waterproof material to ensure the accessories remain dry, and may be fabricating including an enclosure, pockets and the like in any shape or size providing one or more receptacles for holding any of a variety of accessories therein.

Figure 4:
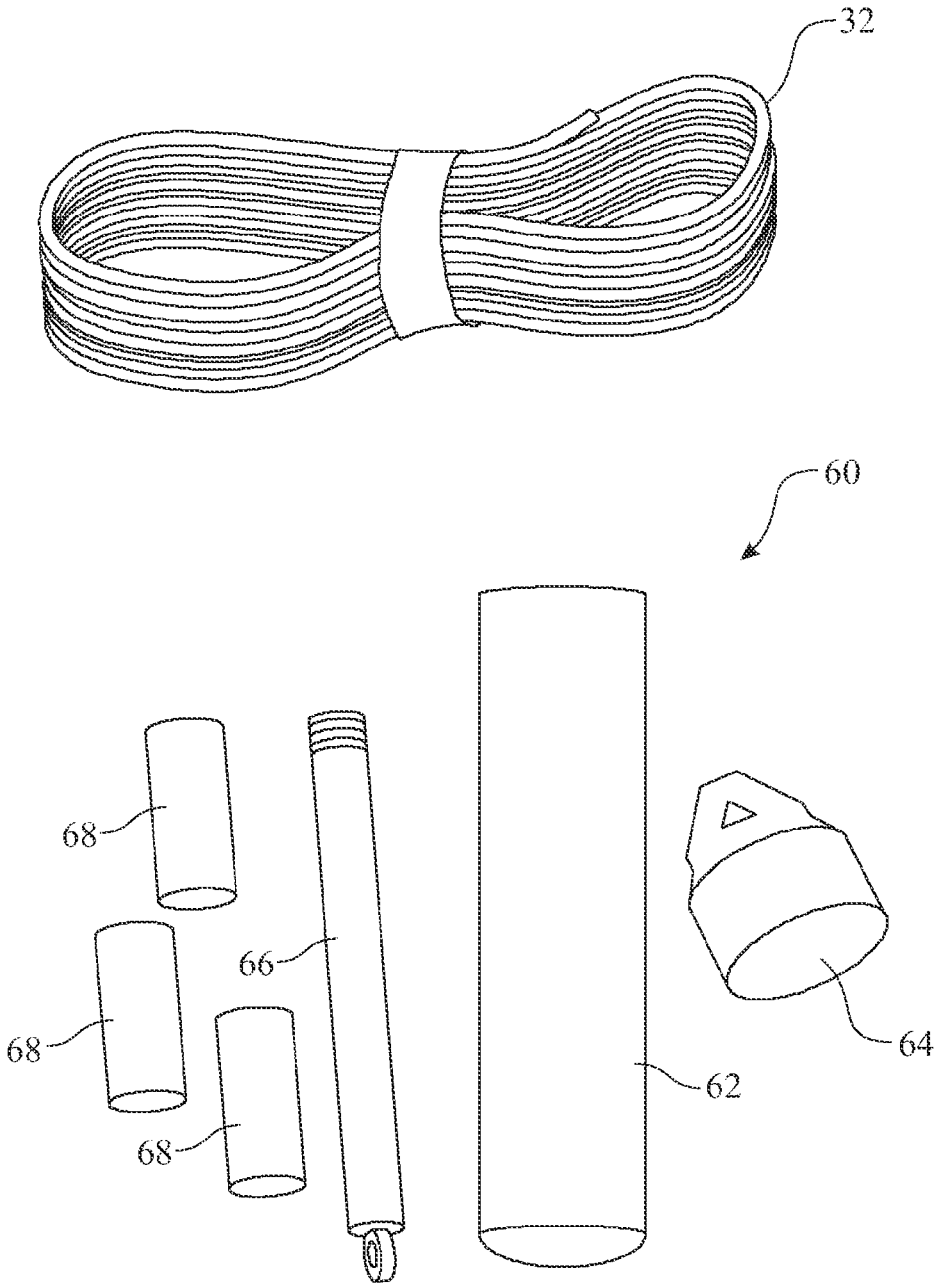
FIG. 4 presents a perspective view of a section of rope and an exploded assembly view of an exemplary flare system, originally stowed within the detachable accessory pouch as illustrated in FIG. 3.
Figure 5:
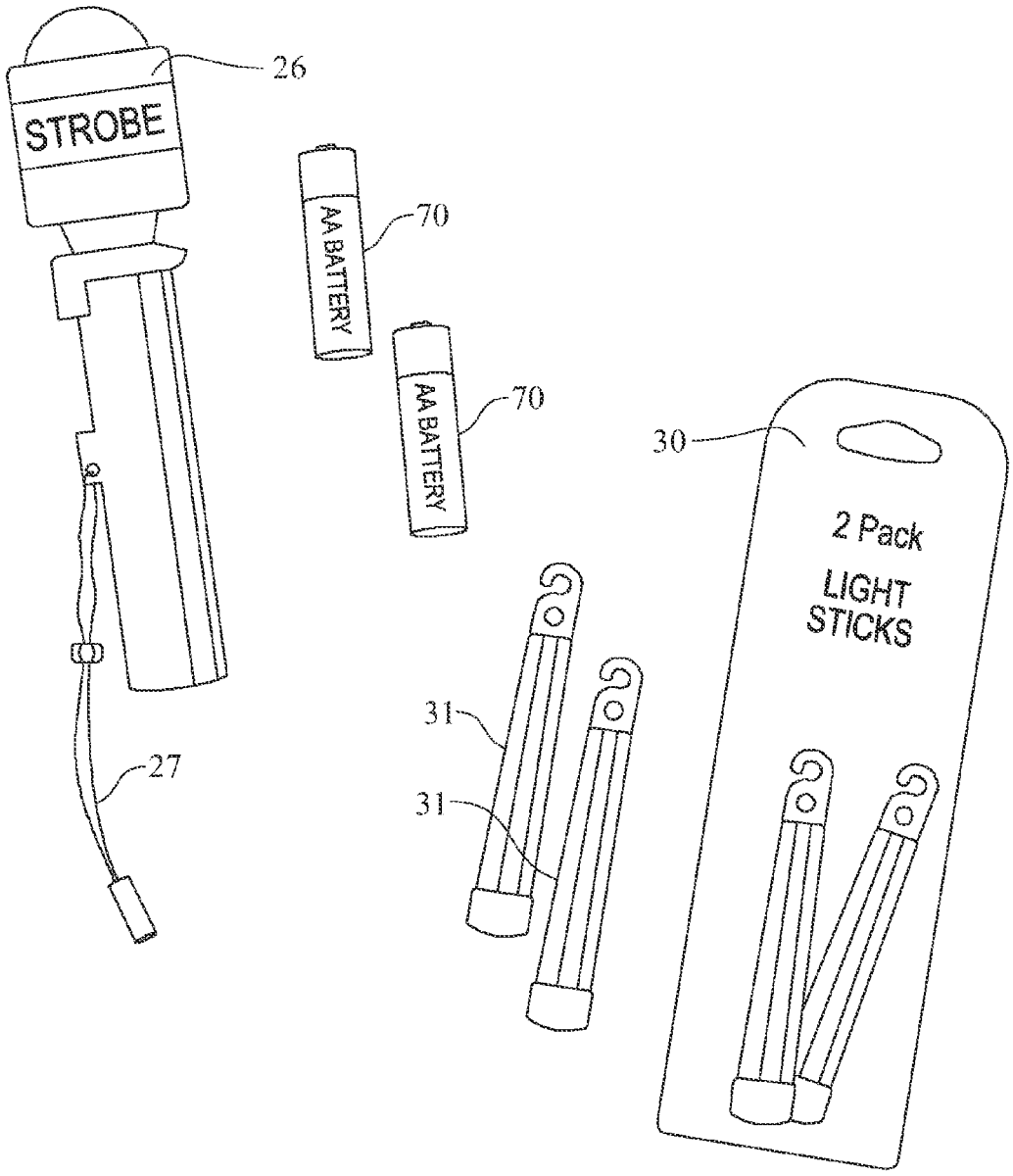
FIG. 5 presents a perspective view of various illumination devices, such as a strobe light and a chemiluminescent glow stick package, originally stowed within the detachable accessory pouch as illustrated in FIG. 3.
Figure 6:
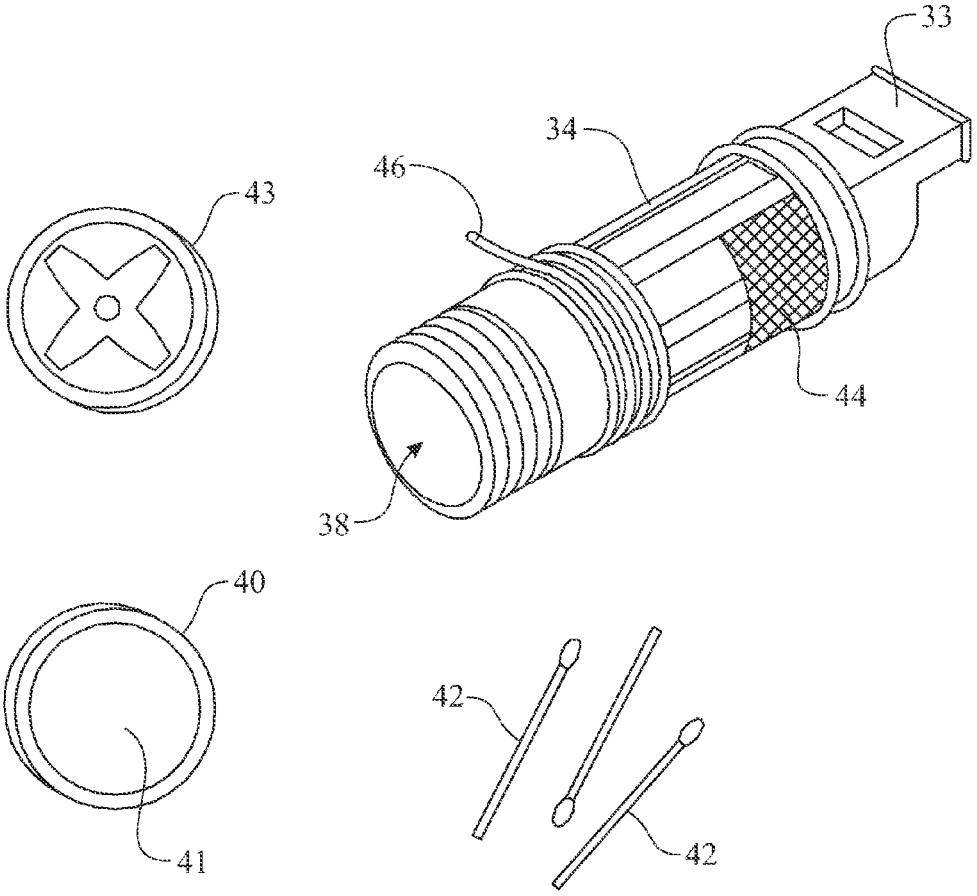
FIG. 6 presents a perspective view of a compact emergency whistle, wherein the whistle includes a container for stowing matches, a reflective material, and the like, the whistle originally being stowed within the detachable accessory pouch or attached to the life raft.

A variety of different accessories that are readily stored within accessory pouch 22 are presented in FIGS. 4 through 6. Such accessories may include tools, food, water, beverages, safely equipment, clothing, maps, lotion, patches, or any small and portable items or other articles a user may wish to pack during the recreational or personal safety use of the inflatable life raft 10. A section of rope 32 and a flare system 60 are introduced in FIG. 4. Some non-limiting examples of a variety of accessories selected for storage within the accessory pouch 22 include a rope 32, and a flare system 60. Rope 32 may comprise any diameter, material and length, such as a 6-foot nylon rope 32. The flare system 60 includes a waterproof flare container 62, and container closure 64. The waterproof flare container 62 is sized to store a flare launcher 66 and a plurality of launchable flares 68. The flare launcher 66 is used to launch the launchable flares 68 skyward to signal boats, rafts, airplanes or other people in the event of an emergency.

Various examples of illuminating objects which can be included within the accessory pouch 22 are illustrated in FIG. 5. A first example of these illuminating objects includes a strobe light 26, additionally comprising a strobe hand strap 27 and one or more batteries 70, which are necessary to power the strobe light 26. The strobe light 26 may utilize bright light emitting bulbs or diodes that emit one or more colors. The strobe light 26 can include a circuit to remain illuminated, flash, or simply cycle on and off over time. The strobe light 26 can include a convenient strobe hand strap 27 for securely holding the strobe light 26 in hand. Preferably the strobe light 26 is fabricated from a waterproof, durable material that permits the strobe light 26 to remain afloat on top of water in the event the strobe light 26 slips loose from a user's hand. Alternatively, strobe light 26 may also include a neck strap for positioning the strobe light 26 around a user's neck, if desired.

A second example of these illuminating objects includes a chemiluminescent glow stick package 30. A chemiluminescent glow package 30 may include a plurality of chemiluminescent sticks 31 that are readily available to provide light to a user. chemiluminescent glow sticks 31 provide a resourceful light source without having to store or rely on an additional flashlight and batteries, thereby taking up less space, and limiting expenses. Extended use of a flashlight tends to drain the batteries overtime. When activated by a user, each chemiluminescent glow stick 31 can provide an efficient light source that lasts for hours.

A whistle 34 is illustrated in FIG. 6. The whistle 34 includes a mouth piece 33, a receptacle 38, a closure 40, and a whistle rope 46. As most standard whistles, mouth piece 33 is designed to be inserted between the user's lips for blowing and generating a whistling sound. The closure 40 is removably secured to the end of whistle 34 using any removable interface. The exemplary interface is a threaded interface. It is understood that any removable interface can be used, including a friction fit, a quick turn disconnect, and the like. The to closure 40 is separated from the whistle 34 to expose an opening of the receptacle 38. The receptacle 38 is sized to receive and store any small items therein in a dry fashion. Some examples of small items may include needle and thread, safety pins, medication such as pills or tablets, patches to patch the raft 10, a small lighter, and/or even wet/dry matches 42.

The closure 40 is removably attached to the end of whistle 34 to secure small items 42 within receptacle 38. The closure 40 can include a compass 43 disposed on the top portion of closure 40, and a reflecting mirror 41 disposed upon a surface of the whistle 34 receiving side of the closure 40. The reflecting mirror 41 is used to reflect sunlight or artificial light to generate a distress signal when needed. When the whistle 34 is fully assembled together, a user can simply attach the whistle 34 to the user's wrist, neck or belt by using a whistle rope 46.

The whistle 34 may be fabricated from stainless steel, durable hard plastic, Brass or any suitable, corrosion proof material. The whistle 34 may include a hook and loop fastener 44 for securely attaching the whistle directly to the inflatable life raft 10. Alternatively, the whistle 34 may be stored within the accessory pouch 22.

Figure 7:
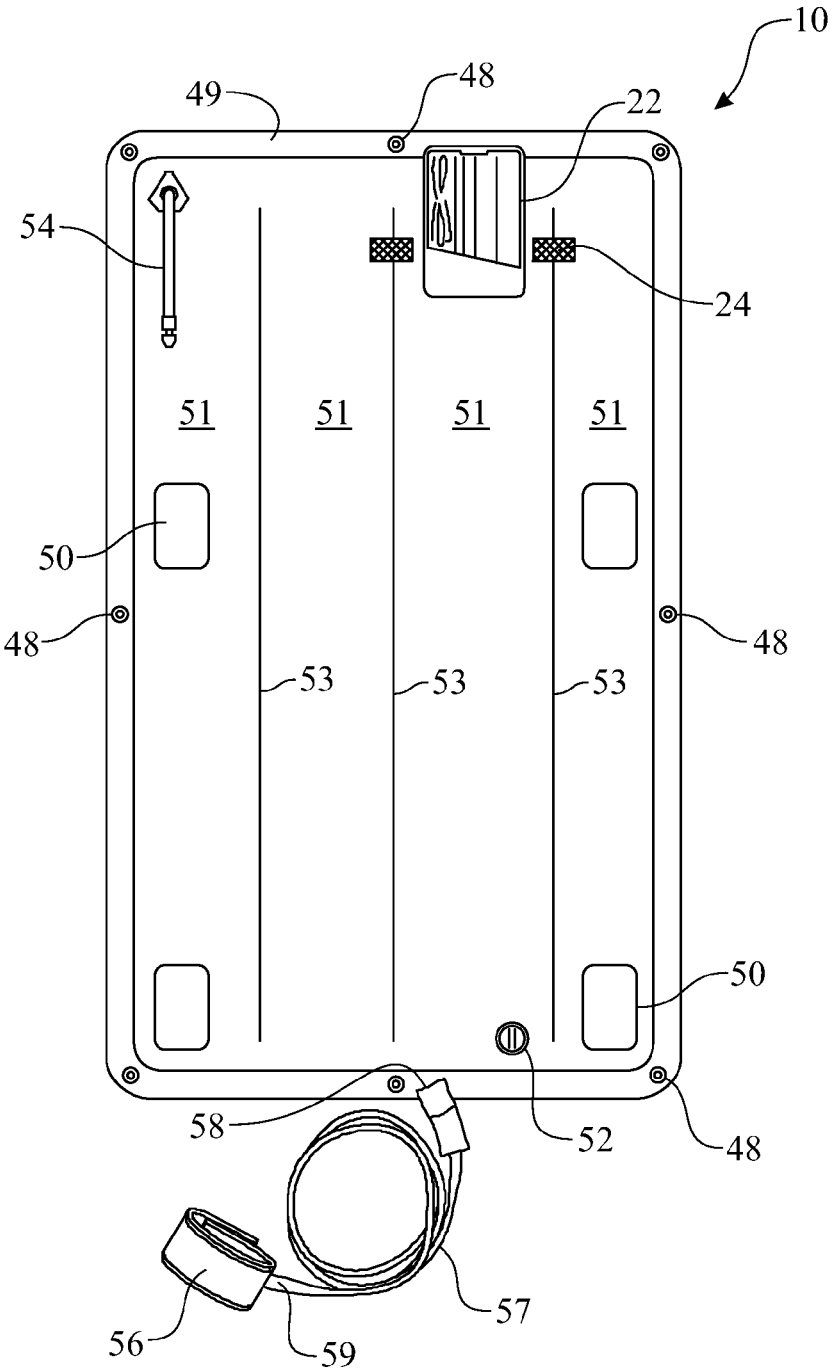
FIG. 7 presents a top view of a first exemplary unfolded, deflated, inflatable life raft having a tether and a plurality of reflectors integrated thereon.

The inflatable life raft 10 is illustrated in a completely unfolded, deflated state in FIG. 7. The illustration includes an inflatable life raft 10 having a tether 57 and a plurality of reflectors 50. The inflatable life raft 10 is preferably fabricated having a generally square or rectangular shape. A plurality of longitudinal inflatable air chambers 51 are arranged in a parallel relationship with one another to form the inflatable chamber of inflatable life raft 10. The term "air channels", "air chambers" and "air tubes" are utilized interchangeably, unless specified to have a distinguishing feature therebetween.

Multiple grommets 48 are assembled along a peripheral edge flap 49 of the inflatable life raft 10 to enable one to tie the inflatable life raft 10 securely to another object, such as a dock or boat. Alternatively, a rope may be intertwined within each grommet 48 along the outer perimeter of the inflatable life raft 10 to provide a component of the inflatable life raft 10 that the user or another individual can hold the inflatable life raft 10. Preferably, each grommet 48 is fabricated from a material that is resistant to corrosion such as brass, stainless steel, or plastic.

In addition to the one-way inflator valve 54 and accessory pouch 22 detachably attached to the surface of the inflatable life raft 10, the inflatable life raft 10 further includes a plurality of reflectors 50 carried by a top or upper surface of the inflatable life raft 10. Each reflector 50 may be disposed anywhere on the upper surface of the raft 10. It is preferred that each reflector 50 is securely positioned along the outer edge of the life raft so that a user does not cover the reflecting abilities of each reflector 50 when tying on the top surface of the raft 10. For example, reflectors 50 may be spatially arranged about the top surface of the inflatable life raft 10. The reflectors 50 can be located proximate each of the four corners of the inflatable life raft 10, at two corners of the inflatable life raft 10, in the middle of the inflatable life raft 10, opposite each other, or about a head or feet region of the inflatable life raft 10. Each reflector 50 is sized and shaped to optimally reflect light or radar signals from the raft 10. The reflectors 50 may be fabricated using reflective tape, reflective plastic, a mirror-like mylar material, or a textile fabric material coated with a metallic material such as a reflective silver coating, metal foil, and the like.

Additionally, each reflector 50 may comprise a radar reflector or any other reflective material that is detectable by radar. Radar reflectors 50 may be disposed about the top surface of the inflatable life raft 10 to allow the raft 10 and user to be detected by radar from a boat or plane. Such reflectors 50 may include a laminated protective cover that is disposed over the reflective material to prevent the reflective material of each reflector 50 from being damaged or contaminated by water. The radar reflectors 50 can be located about the inflatable life raft 10 to reflect at different angles to increase the potential for reflecting a radar signal.

The inflatable life raft 10 also includes a deflator valve 52 and an ankle tether or strap 57. The deflator valve 52 may comprise any valve style that well known in the inflatable industry. As described below, the deflator valve 52 may be adapted to comprise an inflator valve coupled to a replaceable air cylinder 100 for automatically inflating inflatable life raft 10, which will be detailed in the illustration presented in FIG. 11. The tether 57 may be fabricated using a cord, a rope, a flexible, elastic cord such as a bungee cord, and the like. A first tether end 58 of ankle tether 57 is attached to inflatable life raft 10 and a second tether end 59 is attached to a tether attachment feature such as an ankle, waist, or wrist strap 56. The attachment strap 56 is fabricated of a cushioned material comprising a dense hook and loop interface for removeably attaching the attachment strap 56 to a user's ankle, waist, wrist, or other portion of their body, thereby coupling the inflatable life raft 10 to the user. The attachment strap 56 and respective tether 57 not only allow the user to take advantage of the free use of the user's hands and feet, but provides the security of holding onto the inflatable raft 10 in the event of a storm or strong oncoming waves.

A bottom view of an unfolded, deflated lift raft 10 is presented in FIG. 8, wherein the unfolded, deflated lift raft 10 includes an integrally constructed storage carrier 12.

Figure 12:
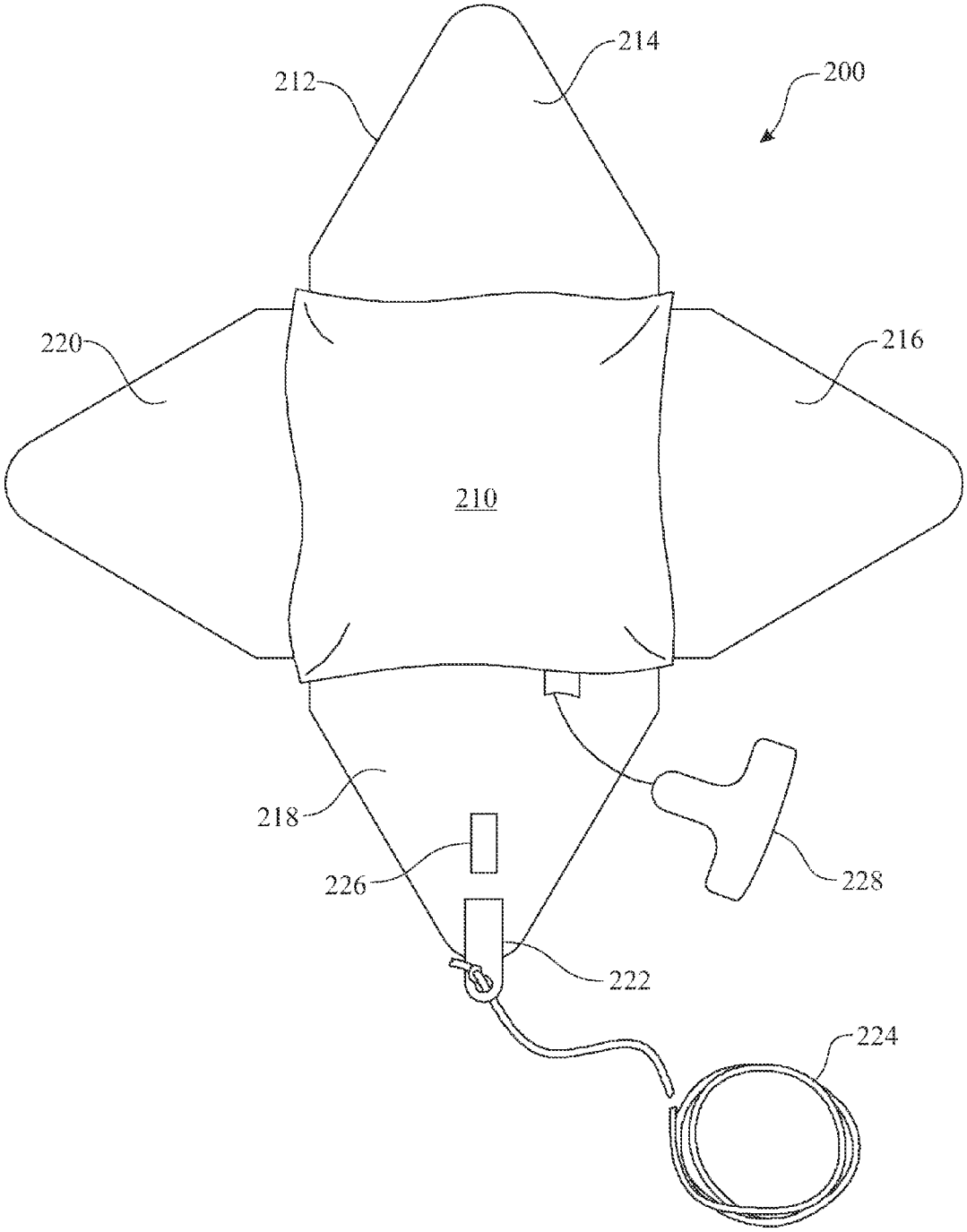
FIG. 12 presents a top view of the inflatable life raft introduced in FIG. 11, wherein the inflatable raft is shown in a deflated and folded configuration and prepared for storage within an easy, deployable storage carrier that is integrally constructed with the device.
Figure 13:
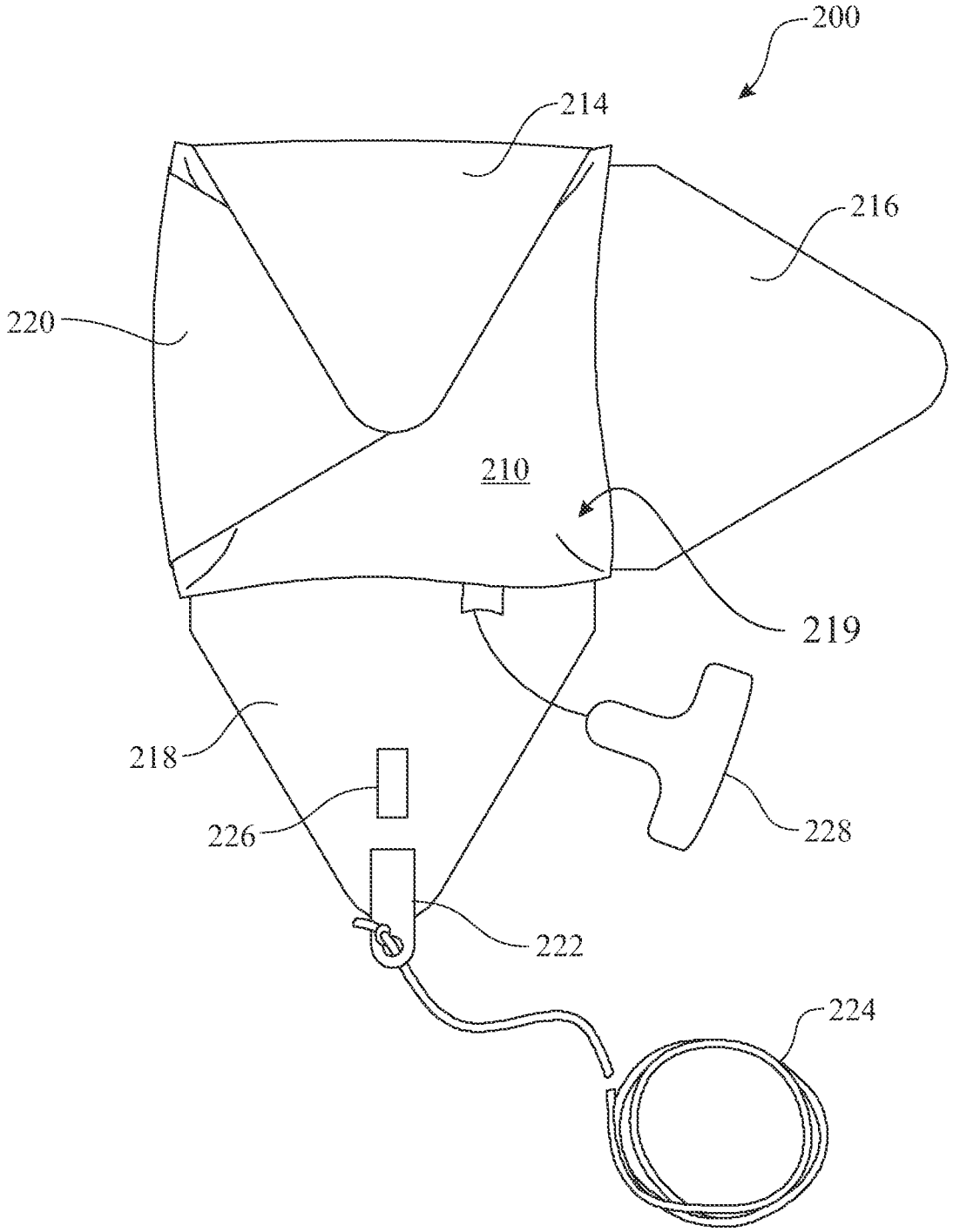
FIG. 13 presents a top view of the inflatable life raft wherein the deployable storage carrier is shown partially enclosing the inflatable life raft therein.
Figure 14:
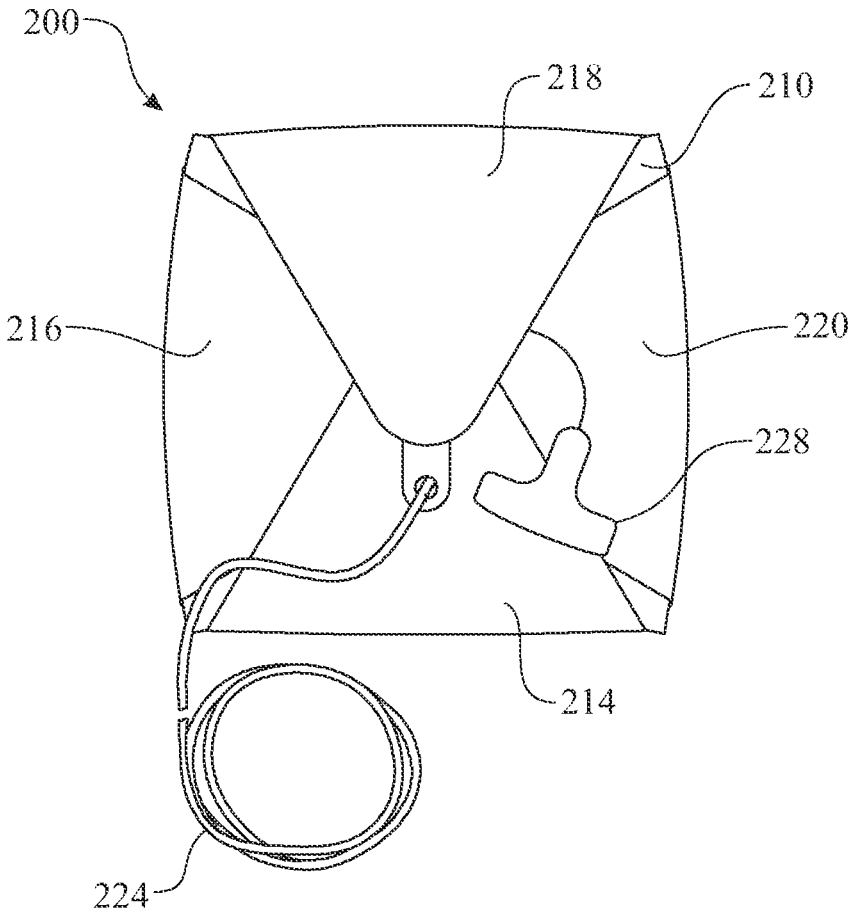
FIG. 14 presents a top view of the inflatable life raft wherein the deployable storage carrier is shown completely enclosing the inflatable life raft therein and ready for use.
Figure 15:
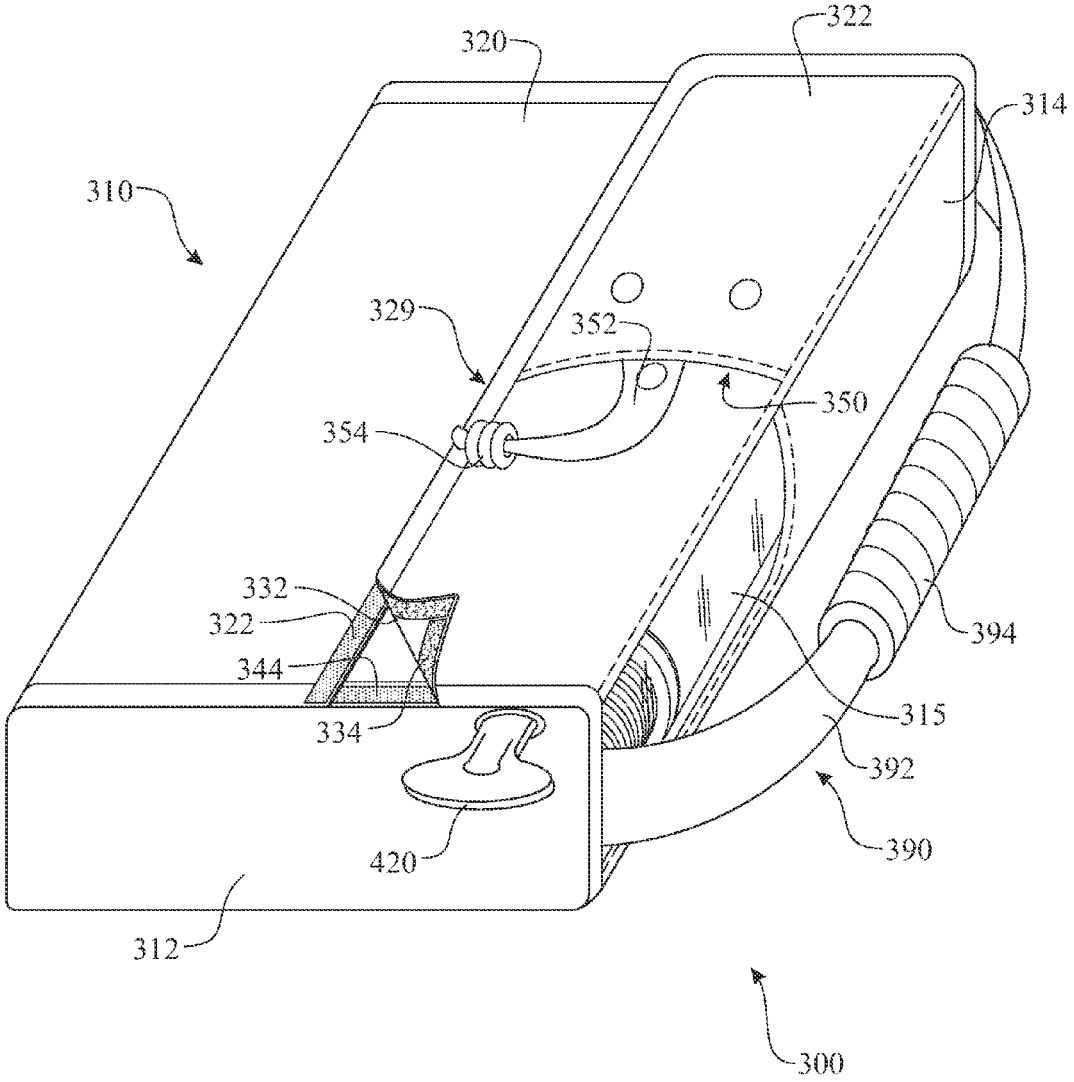
FIG. 15 presents an isometric view of an exemplary deployable inflatable lift raft carrier assembly in accordance with another embodiment of the present invention.

At least one of the panels 13 and 15 of storage carrier 12 can be formed as an integral part of the bottom surface of inflatable life raft 10 as illustrated in FIG. 8. The inflatable life raft 10 is folded longitudinally and transversely into a small, generally square shape and positioned within the opening or receiving portion of storage carrier 12 as illustrated in FIGS. 12 through 14. Once the inflatable life raft 10 is folded and disposed within storage carrier 12, panels 13 and 15 are brought together, being folded along the material hinge 11, as shown in FIGS. 1 and 2. The storage carrier 12 is retained in a stowed configuration by fastening mating portions of the zipper 14, 16 together to provide a compact, stored, inflatable life raft 10, as illustrated in FIG. 1. The attachment clip 18 can be used to removably secure the stored inflatable life raft 10 to a person, a belt, be hung in a closet, or the like.

Figure 9:
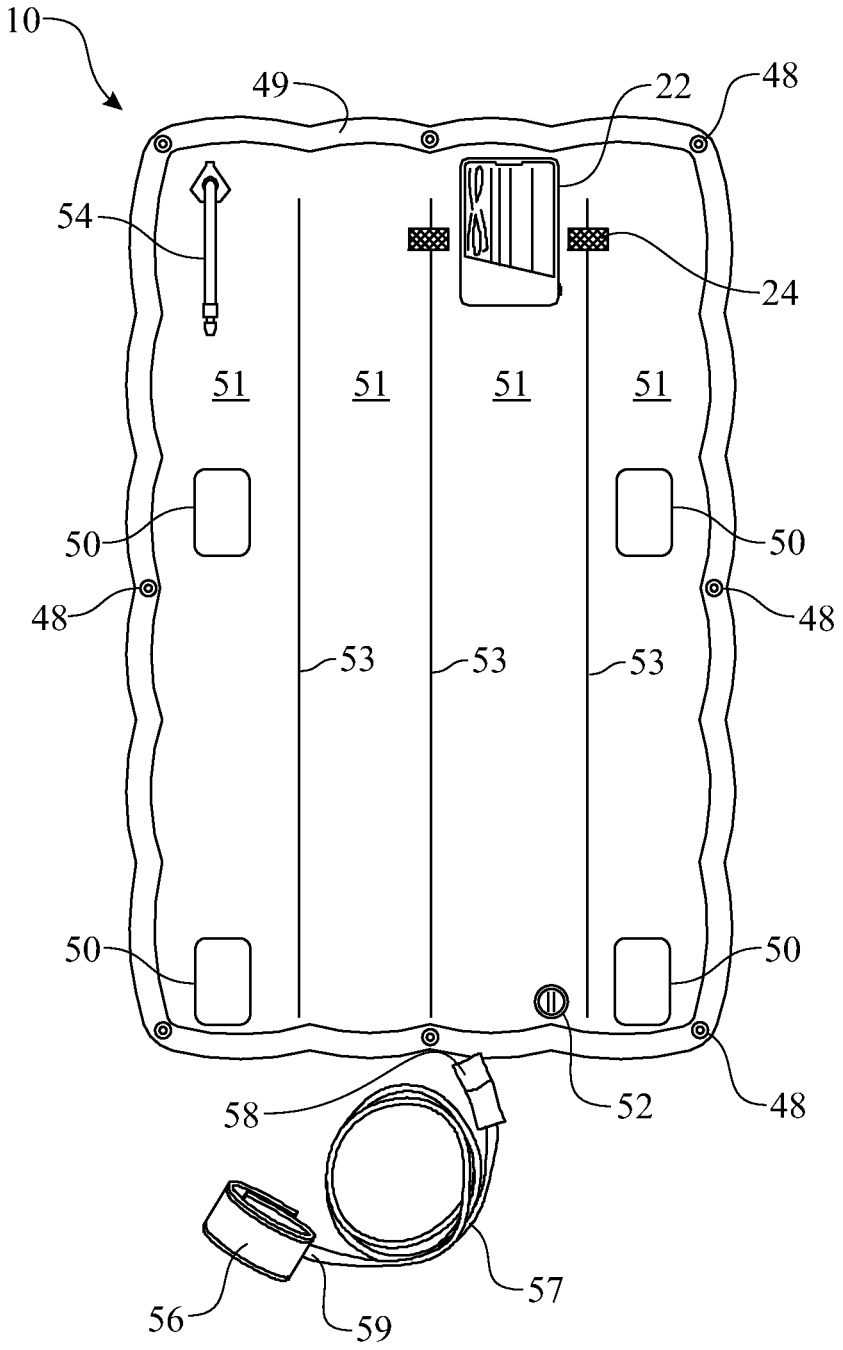
FIG. 9 presents a top view of the inflatable life raft introduced in FIG. 7, wherein the life raft is illustrated in an inflated configuration.

Upon use, fastener 14, 16 is unzipped along panels 13, 15, and panels 13, 15 are unfolded about hinge 11, to unfold inflatable life raft 110 as shown in FIGS. 2, 7, and 8. A user places a mouth piece of the inflator valve 54 between the user's lips and subsequently blows into the inflator valve 54 to fully inflate inflatable life raft 10, as depicted in FIG. 9.

Figure 10A:
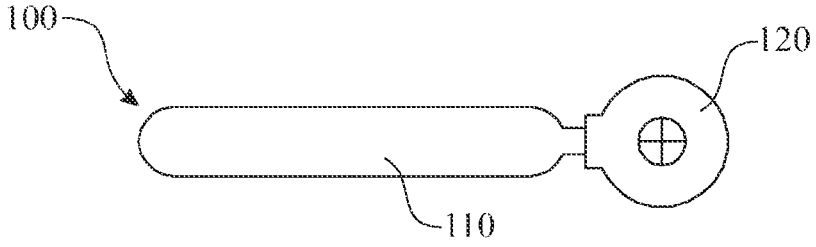
FIG. 10A presents a side view of a replaceable gas cylinder, according to an automated fill embodiment of the readily deployable inflatable life raft assembly.
Figure 10B:
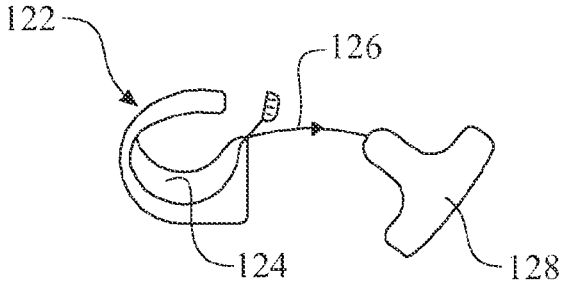
FIG. 10B presents a side view of a replaceable gas cylinder loader for use in conjunction with the replaceable gas cylinder introduced in FIG. 10A.

A replaceable air cylinder 100 and a respective cylinder loader 122 are presented in FIGS. 10A and 10B. The replaceable air cylinder 100 and a respective cylinder loader 122 are used in combination for automatically inflating the inflatable life raft 10. In one embodiment, the replaceable air cylinder 100 includes a light alloy cylinder 110 filled with compressed air. A valve connecting member 120 and the replaceable cylinder 100 are assembled together in fluid communication. The light alloy cylinder 110 is sized to hold at least the requisite amount of air that is needed to inflate inflatable life raft 10, and preferably include at least some additional reserve air. The valve connecting member 120 is adapted to engage with valve 52 for forceable directing air from cylinder 110 into the inflatable life raft 10, as better illustrated in FIG. 11. The replaceable air cylinder 100 is coupled to an air cylinder loader 122. The air cylinder loader 122 includes a cylinder receptacle 124, a loader pull string 126 and a pull string handle 128 attached to a distal end of the pull string 126 for activating air cylinder 110 to inflate inflatable life raft 10.

The air cylinder loader 122 is fixedly disposed on inflatable life raft 10 at a location proximate the valve 52. The replaceable air cylinder 100 is placed within the air cylinder loader 122 and the valve connecting member 120 of air cylinder 100 and the valve 52 are provided in operable fluid communication. The personal safety inflatable life raft 10, along with the replaceable air cylinder 100 and air cylinder loader 122, can be stored in its original pouch shape with little added weight.

In operation, a user unzips the zipper 14 enclosing the storage compartment 12 and grasps the pull string handle 128 in one hand. The user pulls handle 128 to automatically inflate the inflatable life raft 10. Upon activation, air is directed from the light alloy cylinder 110, through the valve member 120, and into the inflatable life raft 10, via the valve 52. Upon activating the replaceable air cylinder 100, the inflatable life raft 10 is immediately inflated and ready for use with very little effort exerted by the user. Thus, the replaceable air cylinder 100 provides a user an automated alternative vehicle for inflating the inflatable life raft 10 in the event a user is unable to use the manual inflator valve 54. After use, the air cylinder 100 can be replaced with a new cylinder for subsequent inflation of raft 10.

In one alternative embodiment, the replaceable air cylinder 100 is a replaceable or refillable gas cylinder 100 such as a CO2 gas cartridge or canister. The CO2 gas cartridge is operatively coupled to the valve 52, via the air cylinder loader 122. Preferably, the CO2 cartridge is pre-attached to the valve 52. However, if desired, the CO2 cartridge may be stored in the accessory pouch 22 and selectively coupled to valve 52 for readily inflating the raft. In operation, the user unzips the zipper 14 of the storage compartment 12, along zipper 14, grasps pull string handle 128 in one hand, and pulls the handle 128. The tensile force applied to the pull string handle 128 activates the CO2 gas cylinder causing the replaceable air cylinder 100 to automatically inflate the inflatable life raft 10. Once activated, CO2 gas flows from the CO2 gas cartridge and is directed into raft 10, via the valve 52. Thus, by pulling the pull string handle 128, CO2 gas is immediately transferred into the inflatable life raft 10 fully inflating the inflatable life raft 10 within a relatively short period of time with little effort exerted by the user. Thus, the replaceable gas cylinder 100 provides an easy, and quick alternative method for quickly inflating inflatable life raft 10. The expired or exhausted CO2 gas cylinder may be easily replaced with a new CO2 gas cylinder, or refilled accordingly.

Figure 10C:
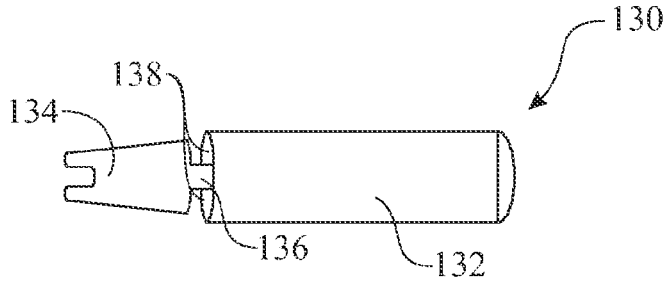
FIG. 10C presents a side view of a manual air pump used for inflating the inflatable life raft introduced in FIG. 1.
Figure 11:
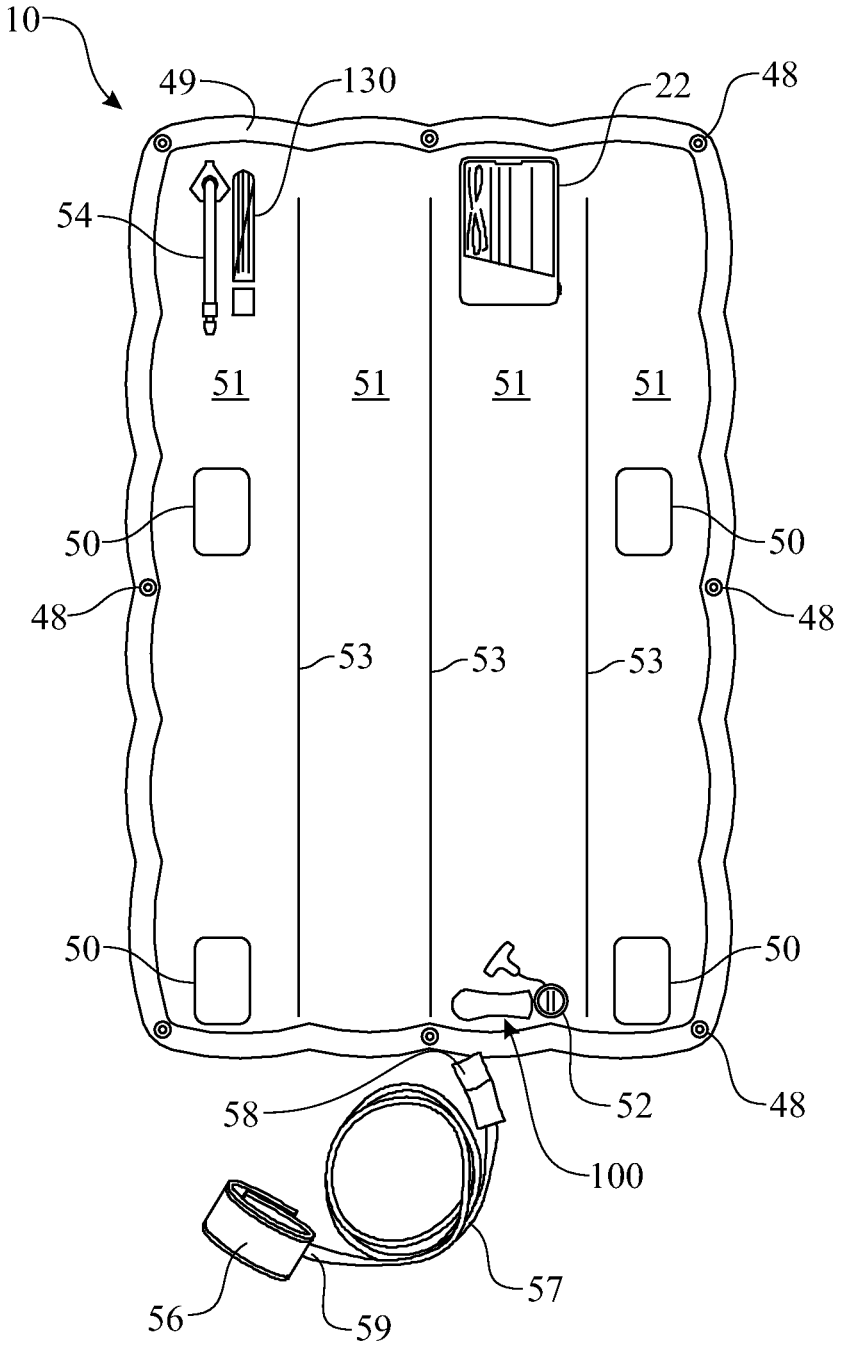
FIG. 11 presents a top view of an enhanced inflatable life raft introduced in FIG. 7, further comprising a replaceable gas cylinder and manual hand pump.

Alternatively, a manual air pump 130 (illustrated in FIG. 10C) can be included for aiding in the process of inflating the inflatable life raft 10. The manual hand pump 130 includes a cylinder 132, a pump connector 134, a shaft 136 and a one-way breather seal 138. The manual hand pump 130 can stored on the raft 10 at a location proximate to the inflating valve 54. The pump connector 134 is adapted to couple to the filler hose or inflating valve 54, as illustrated in FIG. 11. In use, pump connector 134 is coupled to inflating valve 54 and the user uses two hands to stroke shaft 136 back and forth within cylinder 132 to inflate inflatable life raft 10. A user of inflatable life raft 10 has three operative modes of inflating inflatable life raft 10. A first mode includes breathing into fill tube 54, a second mode includes manually inflating inflatable life raft 10 using a hand pump 130, or alternatively a third mode which includes automatically inflating inflatable life raft 10 with a replaceable gas cylinder 100.

A series of top views illustrating steps of storing an exemplary readily deployable inflatable life raft 200 within a storage container 219 of a storage assembly 212 are presented in FIGS. 12 through 14. The storage assembly 212 includes envelope panels 214, 216, 218 and 220. Each panel 214, 216, 218, 220 is fabricated having a generally triangular shape resembling a closure flap of an envelope. The panels 214, 216, 218, 220 foldably combine together to form a storage container 219 for securely storing the inflatable life raft 210. The panels 214, 216, 218, 220 can be integrally constructed termed from a single blank, or comprise separately individual panels that are attached to one side of the raft 210 for readily providing storage as is also outlined in another embodiment with reference being made to panels 13, 15 of FIG. 8. Each panel 214, 216, 218, 220 is dimensioned and sized to cover a corresponding section of raft 210, and is fabricated from any durable material including plastic, fabric, rubber, vinyl and the like.

The storage assembly 212 includes a panel 218 having an extending flap 222 with an opening for receiving one end of a rope 224. The panel 218 can additionally include an assembly fastener 226 for securely holding the panels 214, 216, 218, 220 in a folded position over the folded raft 210. It is understood that the assembly fastener 226 can be provided on any of the panels 214, 216, 218, 220. One non-limiting example of an assembly fastener 226 is a dense hook and loop interface. Other fasteners that can be utilized, providing a similar quick release function include snaps and magnets.

For properly storing the inflatable life raft 210, the inflatable life raft 210 is folded longitudinally and transversely into a small, generally square shape and positioned within a storage container 219 of the storage assembly 212 where each panel 214, 216, 218, 220 extends outwards from all four edges of the folded raft 210 into a planar configuration, as better illustrated in FIG. 12. A storing process is accomplished by sequentially folding each panel 214, 216, 218, 220 over the raft 210 into a folded configuration as illustrated in FIGS. 13 and 14. All four panels 214, 216, 218, 220 are securely folded and retained in the folded configuration by the assembly fastener 226 to create the storage container 219 for storing the raft 210 in a readily deployable manner. An attachment component, such as the attachment clip 18, can be used to removably secure the stored inflatable life raft 10 to a person, belt or hung in a closet or the like, if desired.

When placed in a stored configuration, both the rope 224 and gas cylinder pull handle 228 are readily exposed as illustrated in FIG. 14. To quickly and easily deploy the raft 210, the user grasps the rope 224 and simply pulls gas cylinder pull handle 228. Upon pulling the gas cylinder handle 228, the gas cylinder 100 is activated to rapidly inflate the inflatable life raft 210 where the storage assembly 212 unfolds effortlessly providing for immediate unencumbered deployment and inflation a desired feature in saving lives.

A third exemplary embodiment of a deployable inflatable lift raft carrier assembly 300 is presented in FIGS. 15 through 18. An inflatable life raft 500 is deflated, folded, and stowed within a deployable inflatable lift raft carrier 310 for portability and subsequent unencumbered deployment. The deployable inflatable lift raft carrier 310 is fabricated comprising a peripheral wall comprising a carrier side wall 312 extending between each end of a carrier cartridge wall 314 and a cartridge base wall 316. The peripheral wall extends upward from a peripheral edge of a carrier bottom 318 forming a carrier life raft receptacle 319. A first cover flap 320 is foldably attached to an exposed edge of the cartridge base wall 316. Similarly, a second cover flap 330 is foldably attached to an exposed edge of the carrier cartridge wall 314. The first cover flap 320 and second cover flap 330 are sized to overlap when placed into a folded configuration. The first cover flap 320 and second cover flap 330 include a overlap fastener 322 and a overlap mating fastener 332, respectively, to enable a quick releasing interface along a cover flap overlap 329. The overlap fastener 322 and overlap mating fastener 332 are preferably fabricated of a quick release attachment interface, such as a dense hook and loop tape (as illustrated), a series of snaps, one or more magnets, and the like. The quick release attachment interface enables release between the first cover flap 320 and the second cover flap 330 as the inflatable life raft 500 inflates. The first cover flap 320 and second cover flap 330 are hingeably attached to the cartridge base wall 316 and carrier cartridge wall 314 respectively in a manner that fully exposes an exposed peripheral of the carrier life raft receptacle 319 for unencumbered deployment of the inflatable life raft 500. The overlap fastener 322 and overlap mating fastener 332 can be additionally supported along each of their edges by integrating a side flap 340 along each exposed edge of the carrier side wall 312. The side flap 340 is foldable attached to the deployable inflatable lift raft carrier 310 along at least a portion of the exposed edge of each deployable inflatable lift raft carrier 310. The side flaps 340 are hingeably attached to the cartridge base wall 316 and carrier cartridge wall 314 respectively in a manner that fully exposes an exposed peripheral of the carrier life raft receptacle 319 for unencumbered deployment of the inflatable life raft 500. A mating edge fastener 344 is applied to a contacting surface of the side flap 340. A mating cover edge fastener 324 and cover edge fastener 334 are provided along mating edges of the first cover flap 320 and second cover flap 330 respectively. The cover edge fastener 324, cover edge fastener 334, and mating edge fastener 344 are preferably fabricated of a quick release attachment interface, such as a dense hook and loop tape (as illustrated), a series of snaps, one or more magnets, and the like. For consistency, the cover edge fastener 324, cover edge fastener 334, and mating edge fastener 344 are preferably fabricated of the same connection interface as the overlap fastener 322 and overlap mating fastener 332. The deployable inflatable lift raft carrier 310 is preferably fabricated of a fabric, such as canvas, or other flexible material.

The deployable inflatable lift raft carrier assembly 300 includes several features to improve the functionality and comfort for the user. A carrier handle 390 is attached to the body of the deployable inflatable lift raft carrier 310. The carrier handle 390 includes a handle grip 394 attached to the deployable inflatable lift raft carrier 310 by a handle strap 392. A cartridge viewing window 315 can be integrated into the carrier cartridge wall 314 enabling the user or other party the ability to visually inspect the deployable inflatable lift raft carrier assembly 300 to ensure a replaceable air cylinder assembly 400 is properly filled. A tether pocket 350 can be integrated into the deployable inflatable lift raft carrier assembly 300 to stow a tether, such as the tether 57. The tether can be gathered and inserted into the tether pocket 350 with a tether fastener 352 partially extending outward from the tether pocket 350. A tether removal grip 354 can be attached to a distal end of the tether fastener 352. The tether removal grip 354 aids the user in withdrawing the tether from the tether pocket 350. The tether removal grip 354 also retains the tether fastener 352 in a desired position, partially extending from the tether pocket 350.

An inflatable life raft 500 is integrated into the deployable inflatable lift raft carrier assembly 300. The inflatable life raft 500 is detailed in the illustration presented in FIG. 18. The exemplary inflatable life raft 500 is fabricated having a plurality of longitudinal inflatable air chambers 551 arranged in a parallel relation with one another. The plurality of longitudinal inflatable air chambers 551 can be provided having a single air retaining chamber or be divided into multiple air retaining chambers. In the unitary air retaining chamber configuration, the inflatable life raft 500 only requires a single inflator valve 554. In the multiple air retaining chamber configuration, the inflatable life raft 500 requires at least one inflator valve 554 per longitudinal inflatable air chambers 551. At least one reflective medium 550 is attached to one or both surfaces of the inflatable life raft 500. The reflective medium 550 would be similar to the reflectors 50 previously presented above. The gas impervious chamber 510 is fabricated including a outer edge flap 549 about a perimeter thereof. The outer edge flap 549 is preferably void of any air chambers. A series of grommets 548 are attached to the outer edge flap 549, providing a reinforced passage for items such as a peripheral grab rope 560. The grommets 548 can be located at each of the four corners and at any location along the outer edge flap 549 therebetween. The peripheral grab rope 560 can be routed along either side (as illustrated) or completely around the entire periphery of the gas impervious chamber 510. A grab strap 570 can be attached to the outer edge flap 549 by an adhesive, stitching, rivets, grommets, and the like. The inflatable life raft 500 can include the peripheral grab rope 560, the grab strap 570 or both. It is desired to attach the inflatable life raft 500 to the deployable inflatable lift raft carrier assembly 300 enabling retention of all components. In the illustration, the deployable inflatable lift raft carrier assembly 300 is presented retaining the original shape. The deployable inflatable lift raft carrier assembly 300 is presented in this manner to retain consistency and clarity throughout the application. It is understood that the deployable inflatable lift raft carrier assembly 300 will commonly deform during deployment of the inflatable life raft 500, often inverting. It is understood that the inflatable life raft 500 can be provided in any reasonable size, shape, or configuration to meet the desired needs of the user.

Figure 16:
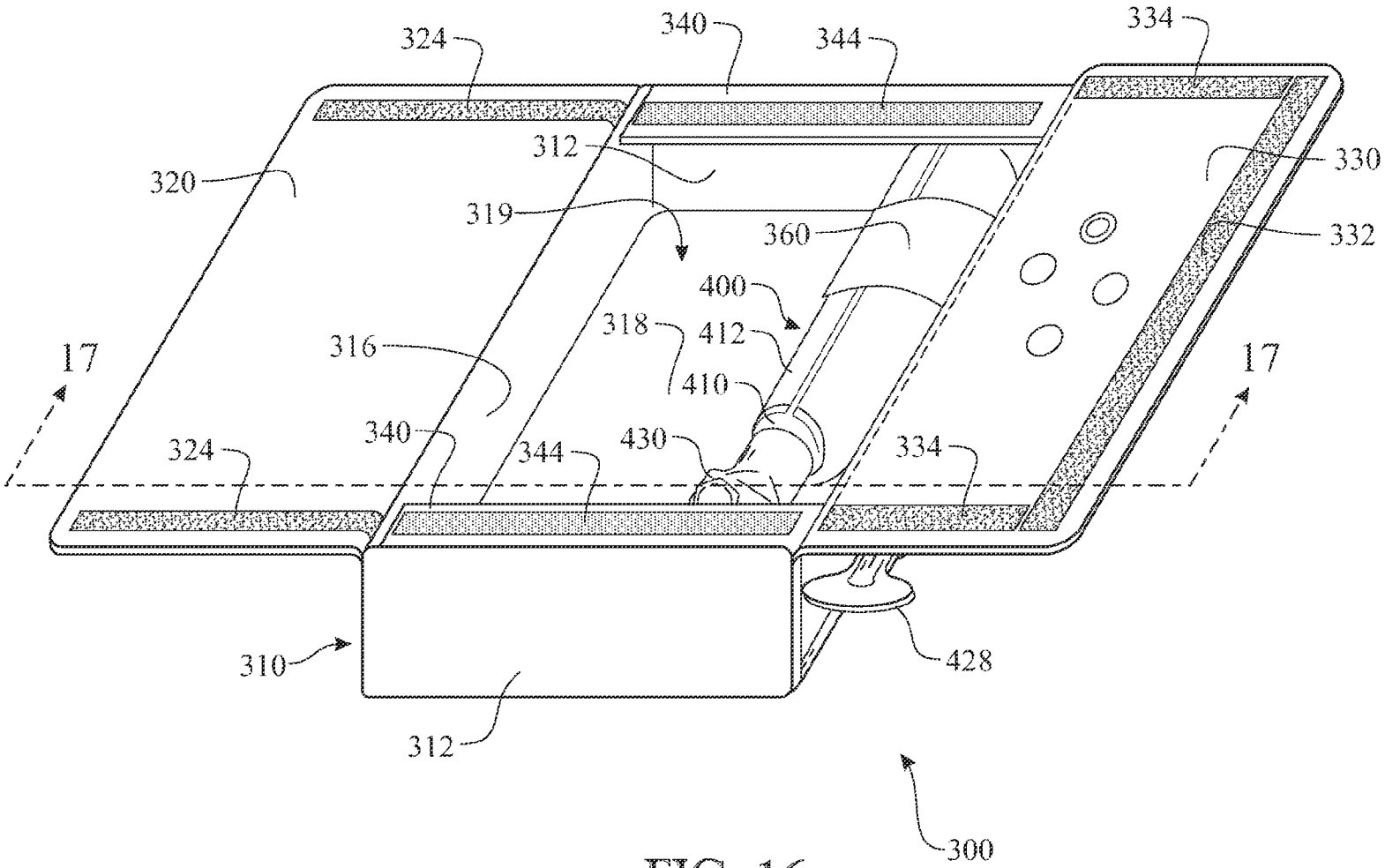
FIG. 16 presents an isometric view of the exemplary deployable inflatable lift raft carrier assembly originally introduced in FIG. 15, the carrier shown in an opened configuration and excluding the inflatable life raft for clarity.
Figure 18:
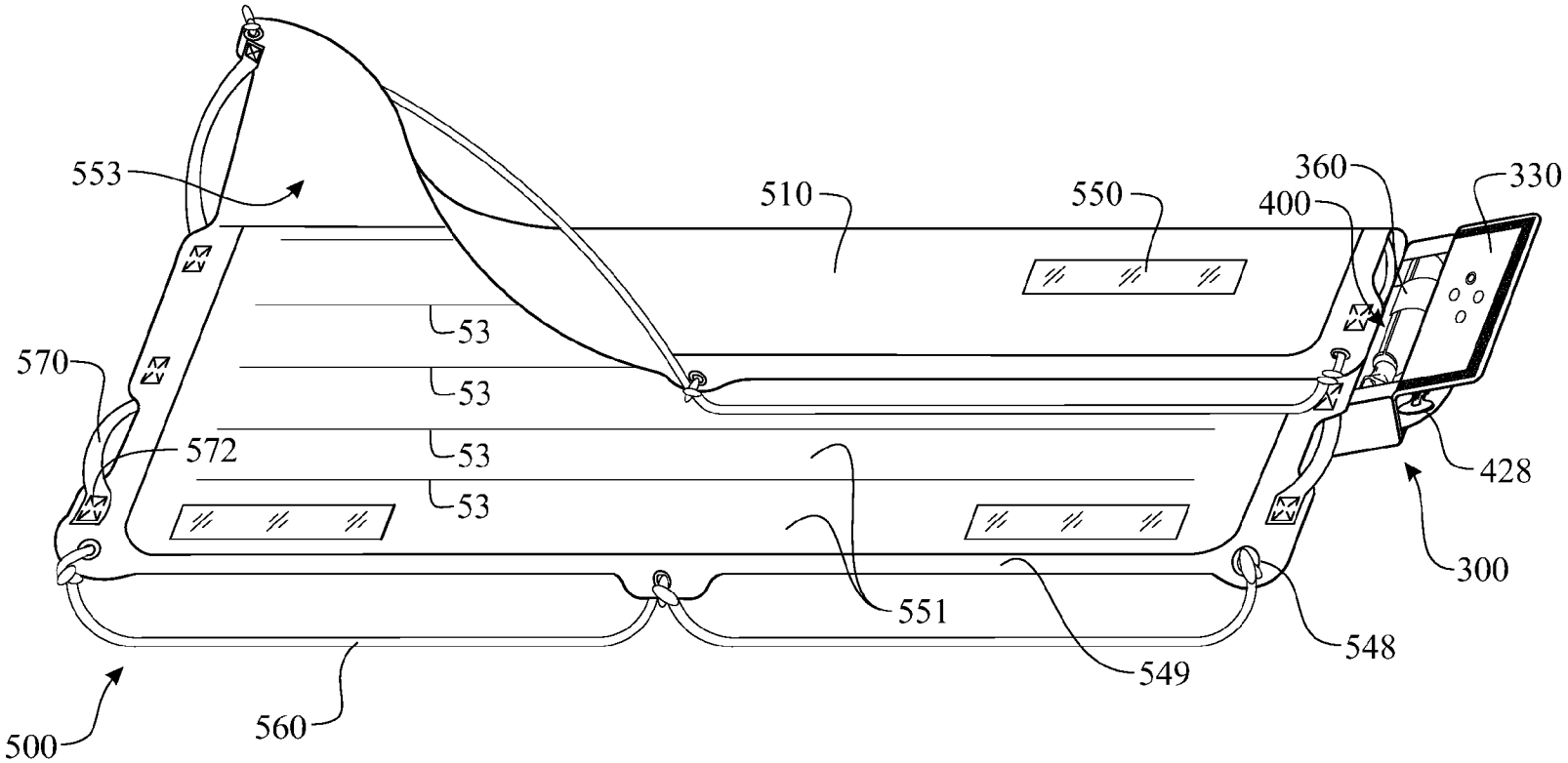
FIG. 18 presents an isometric view of the exemplary deployable inflatable lift raft carrier assembly, illustrating the inflatable life raft in a partially deployed configuration.
Figure 19:
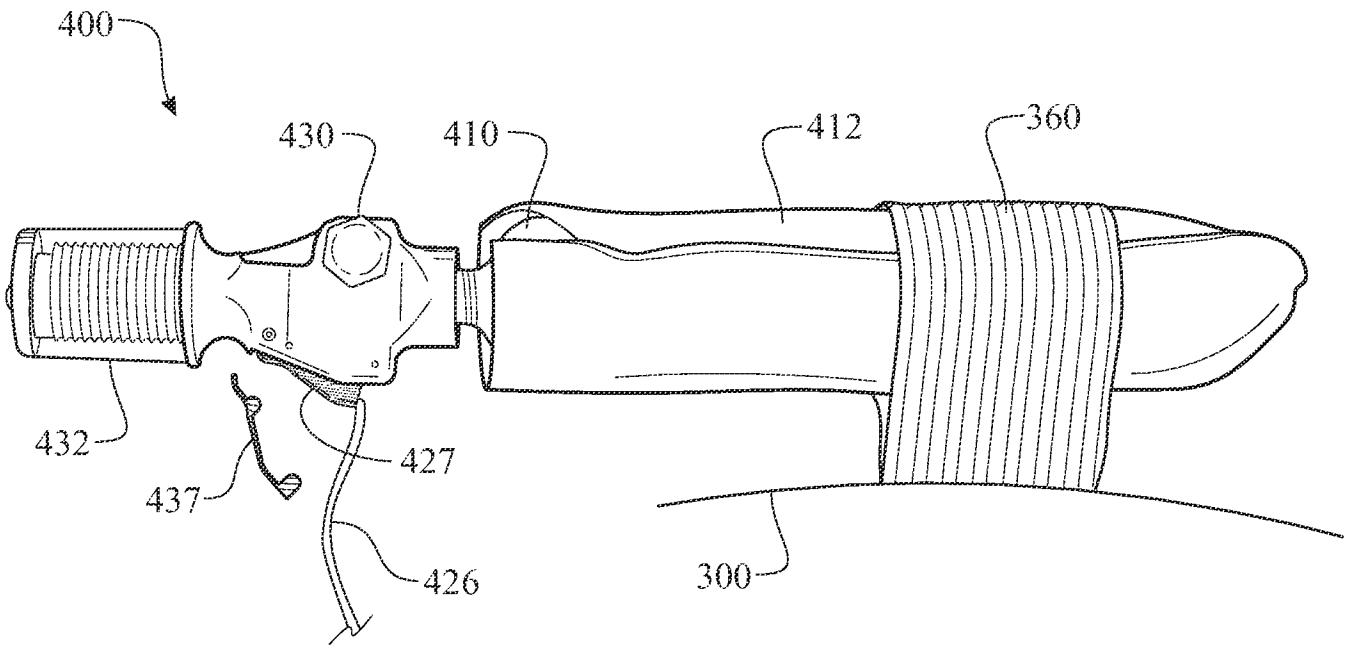
FIG. 19 presents an isometric view of an exemplary replaceable air cylinder assembly.

A replaceable air cylinder assembly 400 is inserted into a air cylinder sleeve 412 and secured within the deployable inflatable lift raft carrier 310 by a air cylinder retainer 360, as illustrated in FIG. 16 and detailed in FIG. 19. The replaceable air cylinder assembly 400 is similar to the replaceable air cylinder 100 described earlier. The replaceable air cylinder assembly 400 includes a compressed air cylinder 410 for storing pressurized air or gas. A air cylinder fill control assembly 430 can be removably attached to the compressed air cylinder 410 for operational conveyance of the gas within compressed air cylinder 410. The replaceable air cylinder assembly 400 can include a air fill indicator 432 to indicate the presence of pressurized air or gas within the compressed air cylinder 410. A first end of the loader pull string 426 is attached to a valve within the air cylinder fill control assembly 430 and a second end of the loader pull string 426 is attached to a cylinder actuating grip 428. A distal end of the loader pull string 426 is retained in location by a handle retention member 429. The cylinder actuating grip 428 is located external to the carrier life raft receptacle 319, providing quick and easy access of the cylinder actuating grip 428 to the user. The replaceable air cylinder assembly 400 can release air using a manual control valve or an automated control valve. One exemplary operational control for the automated valve is a actuator 427. The fill actuator 427 pivots forward actuating the valve to release the gas from within the compressed air cylinder 410, allowing the gas to transfer from the compressed air cylinder 410 to the longitudinal inflatable air chambers 551 (FIG. 18) of the inflatable life raft 500. A fill actuator status indicator 437 is clipped over the fill actuator 427 to indicate that the fill actuator 427 has been activated. The fill actuator 427 and fill actuator status indicator 437 are fabricated in different colors, enabling visual inspection to determine whether the fill actuator 427 has been activated. In the exemplary embodiment, the fill actuator status indicator 437 is fabricated having a green colored exterior and the fill actuator 427 is fabricated having a red colored exterior. Green represents good (filled); red represents bad (exhausted). The replaceable air cylinder assembly 400 is placed within the deployable inflatable lift raft carrier 310 orienting the fill actuator status indicator 437 towards the cartridge viewing window 315 for ease of visual inspection. The replaceable air cylinder assembly 400 and the inflatable life rail 500 are attached in fluid communication by a gas impervious conduit, such as a section of rubber tubing. This is similar to the tether 57 previously disclosed herein.

Figure 17:
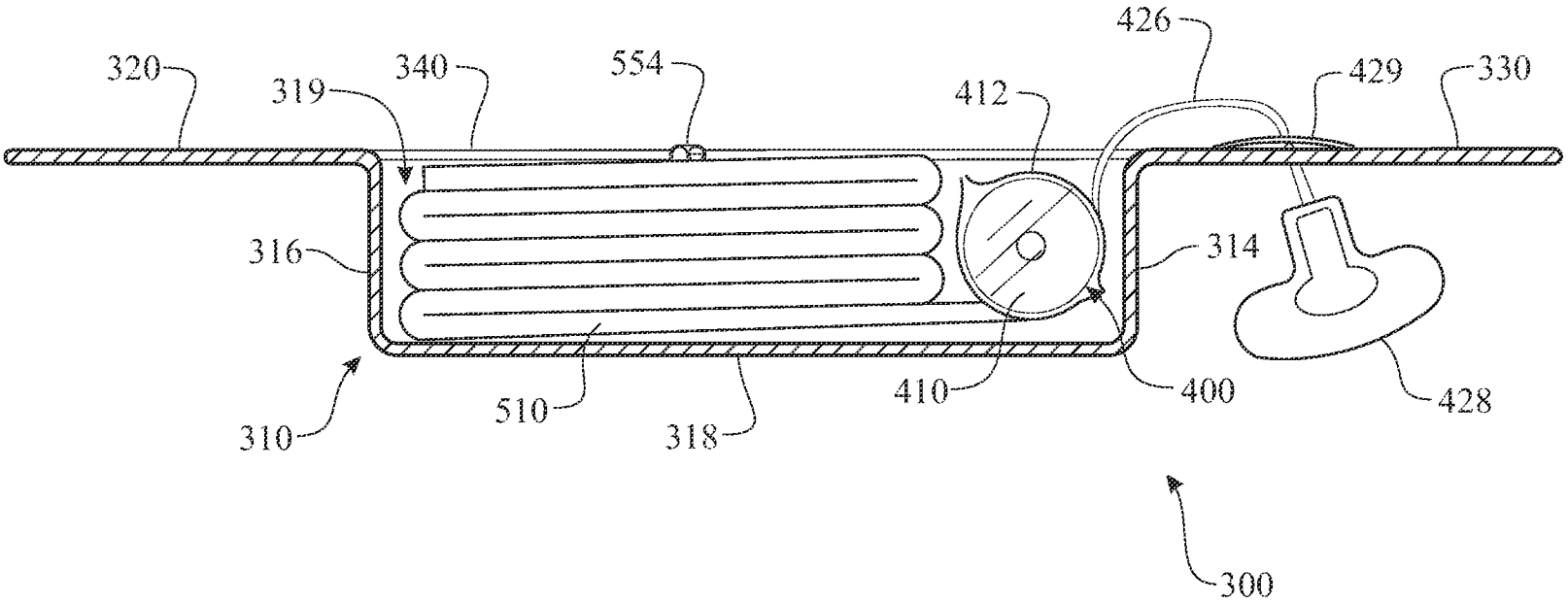
FIG. 17 presents a side section view of the exemplary deployable inflatable lift raft carrier assembly, the section taken along section line 17-17 of FIG. 16, the carrier shown in an opened configuration including the inflatable life raft stowed therein.

The filled compressed air cylinder 410 is attached to the inflatable life raft 500 as described above. The inflatable life raft 500 is completely deflated, folded in an overlapping manner along a longitudinal direction, and finally folded in a pleated manner along a lateral direction. The inflatable life raft 500 is preferably folded in thirds longitudinally as illustrated in FIG. 18. The compacted inflatable life raft 500 is placed within the carrier life raft receptacle 319 as illustrated in FIG. 17. It is understood that the inflatable life raft 500 can include markings to aid the user in properly folding the inflatable life raft 500 into the desired finished size. The first cover flap 320 is folded, covering a portion of the open end of the carrier life raft receptacle 319. The first cover flap 320 can be secured in a closed configuration by engaging the cover edge fastener 324 and the optional mating edge fastener 344 together. The second cover flap 330 is then folded, covering the remaining exposed portion of the open end of the carrier life raft receptacle 319. The second cover flap 330 is secured in a closed configuration by engaging the overlap mating fastener 332 and the overlap fastener 322 together. The second cover flap 330 can be additionally retained in a closed configuration by engaging the cover edge fastener 334 and the optional mating edge fastener 344 together. When the user applies a tensile force to the cylinder actuating grip 428, the force activates the air cylinder fill control assembly 430 and the replaceable air cylinder assembly 400 begins to transfer the pressurized gas to the longitudinal inflatable air chambers 551 of the gas impervious chamber 510. As the gas impervious chamber 510 inflates, the force disengages the mechanical coupling temporarily retaining the overlap fastener 322 and overlap mating fastener 332 together. The inflation additionally disengages the mechanical coupling temporarily retaining the cover edge fastener 324, cover edge fastener 334 and mating edge fastener 344 together, in a configuration where this would be applicable. The overall design thus enables unencumbered deployment of the inflatable life raft 500 from within the deployable inflatable lift raft carrier 310.

The user would deploy the inflatable life raft 500 from within the deployable inflatable lift raft carrier assembly 300. At some point before, during or shortly after the deployment process, the user can attach the tether fastener 352 to their body. This ensures the inflatable life raft 500 remains with the user until rescue or finished using the inflatable life raft 500.

It is understood that any of the features presented in the embodiments may be integrated into any of the other embodiments.

The advantages of the present invention offers an inflatable life raft 10 that can be easily stored in compact form, can be easily carried and transported, and can be used for both recreation and personal safety. The inflatable life raft 10 can be fabricated in a variety of different dimensions and made readily accessible to children and adults. The present invention also provides the advantages of an inflatable life raft 10 having a detachable waterproof pouch for holding a variety of safety items or accessories made available to a user at all times, and a tether for coupling the inflatable life raft 10 to a user if desired. Advantageously, the present invention provides three modes for operatively inflating inflatable life raft 10 one of which includes an automatic mode of inflation.

The inflatable life raft of the present invention may be constructed to include an inflatable boat, mattress, bed, or any other suitable inflatable life raft used for recreation or personal safety. As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but defined in accordance with the foregoing claims appended hereto and their equivalents.

What is claimed is:

1. An inflatable and foldable life raft comprising:

a plurality of parallel air chambers forming a generally rectangular shaped body when said life raft is in an unfolded and inflated configuration;

at least one valve in fluid communication with said air chambers for inflating and deflating said chambers;

a tether connected to said body, said tether comprising a tether attachment to a user; and a storage carrier constructed integrally with a surface of said body, said storage carrier comprising:

a base wall, side walls, and at least one closure flap extending from a side wall, a handle, and a fastener; wherein said body is deflatable and foldable from said unfolded and inflated configuration to a folded and deflated configuration in which the body is stored within the storage carrier and secured within the storage carrier by said fastener, and wherein said body is deployable from said folded and deflated configuration to said unfolded and inflated configuration by fluid passing through said at least one valve into said chambers causing said body to inflate and disengage said fastener.

2. The life raft of claim 1, wherein said life raft is fabricated from a material composed of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

3. The life raft of claim 1, wherein said at least one valve comprises a first valve having a filling stem for inflating said air chambers, and a second valve for releasing or inserting air from or within said air chambers.

4. The life raft of claim 1, wherein said tether includes a tether strap, one end of said tether strap attached to said body, and a second end of said tether strap attached to an ankle attachment for removeably attaching said tether on a user's ankle.

5. The life raft of claim 1, further comprising an accessory pouch releasably attached to one surface of said body for storing at least one accessory therein, wherein said accessory pouch includes a fastener for securely storing said at least one accessory.

6. The life raft of claim 1, further including a plurality of reflectors disposed on said one surface of said body.

7. The life raft of claim 1, wherein said life raft includes a plurality of grommets disposed along an outside perimeter flap of said body.

8. The life raft of claim 3, wherein said life raft further includes a replaceable gas cylinder and a manual air pump, said replaceable gas cylinder stored within a cylinder loader and coupled to said second valve for inflating said life raft, said manual air pump releasably coupled to said first valve for manually inflating said life raft.

9. The inflatable life raft of claim 1, wherein said fastener includes any one of a spring clip, zipper, hook and loop, buckle, snaps, strap, cord, quick release, magnets, hooks, clasps, carabiner, or any combination thereof.

10. An inflatable recreational or personal safety raft comprising;

a first sheet joined and sealed to a second sheet to form a rectangular shaped body having a plurality of parallel, longitudinally extending inflatable air tubes, and an outer perimeter flap;

a storage carrier integrally formed with said second sheet, said storage carrier comprising a base wall and side walls defining an opening for receiving said body in the folded deflated form, said storage carrier having a closure and a fastener for securely storing said body therein, and a handle;

at least one valve in fluid communication with said inflatable air tubes; and a tether attached to said inflatable raft, said tether including a fastener for coupling said inflatable raft to a user's ankle, waste or wrist; wherein said body is deflatable and foldable from an unfolded inflated form to a folded deflated form in which the body is stored within the storage carrier and secured within the storage carrier by said fastener, and wherein said body is deployable from said folded deflated form to said unfolded inflated form by fluid passing through said at least one valve into said air tubes causing said body to inflate and disengage said fastener.

11. The inflatable recreational or personal safety raft of claim 10, wherein said sheets comprise a single ply or multiple ply of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

12. The inflatable recreational or personal safety raft of claim 10, wherein said at least one valve includes a one-way valve for directing air in said air tubes, and a deflator valve for releasing air from said air tubes.

13. The inflatable recreational or personal safety raft of claim 10, further comprising a waterproof pouch for storing at least one of a rope, a flare launching system, a strobe light, glow sticks, and a whistle, said whistle including a receptacle for receiving small items, and a closure having a reflecting mirror and a compass.

14. The inflatable recreational or personal safety raft of claim 10, further including any one of a plurality or reflectors disposed on an outer surface of said first sheet, a plurality of grommets secured along the outer perimeter flap, a replaceable gas cylinder stored within a cylinder loader and coupled to at least one valve for inflating said life raft, and a manual air pump releasably coupled to at least one valve for manually inflating said life raft.

15. The inflatable recreational or personal safety raft of claim 10, wherein said fastener includes any one of a spring clip, zipper, hook and loop, buckle, snaps, strap, cord, quick release, magnets, hooks, clasps, carabiner, or any combination thereof.

* * * * *